US007240671B2

(12) United States Patent
Takahashi

(10) Patent No.: US 7,240,671 B2
(45) Date of Patent: Jul. 10, 2007

(54) DEVICE FOR CORRECTING FUEL INJECTION AMOUNT OF INTERNAL COMBUSTION ENGINE, AND CONTROL APPARATUS FOR INTERNAL COMBUSTION ENGINE EMPLOYING THE DEVICE

(75) Inventor: Tatsuhiko Takahashi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/373,312

(22) Filed: Mar. 13, 2006

(65) Prior Publication Data

US 2007/0089720 A1 Apr. 26, 2007

(30) Foreign Application Priority Data

Oct. 25, 2005 (JP) ..... 2005-309874

(51) Int. Cl.
*F02D 41/14* (2006.01)

(52) U.S. Cl. ..... 123/686; 123/687; 123/689; 123/696; 701/109

(58) Field of Classification Search ..... 123/685–687, 123/689, 694, 696; 701/109
See application file for complete search history.

(56) References Cited

U.S. PATENT DOCUMENTS 5,787,868 A * 8/1998 Maki et al. ..... 123/694
6,684,868 B2 * 2/2004 Saga ..... 123/674
7,117,045 B2 * 10/2006 Hittle et al. ..... 123/689

FOREIGN PATENT DOCUMENTS

JP 2003-232248 A 8/2003

* cited by examiner

*Primary Examiner*—T. M. Argenbright
(74) *Attorney, Agent, or Firm*—Sughrue Mion, PLLC

(57) ABSTRACT

To prevent RPM decrease, misfire, and engine stall by refraining from correcting, the amount of fuel to shift an air-fuel ratio toward a lean side to the extent of exceeding a combustion limit when the internal combustion engine operates at a low load, a control apparatus is provided for controlling operation of an internal combustion engine. The apparatus includes an air-fuel ratio state determiner, a characteristic retainer and a fuel correction amount calculator, in which a coolant temperature coefficient of a coolant temperature coefficient characteristic is set to be smaller than a constant value in a region where a coolant temperature is lower than a constant temperature.

13 Claims, 14 Drawing Sheets

DEVICE FOR CORRECTING FUEL INJECTION AMOUNT OF INTERNAL COMBUSTION ENGINE, AND CONTROL APPARATUS FOR INTERNAL COMBUSTION ENGINE EMPLOYING THE DEVICE

BACKGROUND OF THE INVENTION

1. Field of the Invention

The present invention relates to fuel control of an internal combustion engine, and more particularly to a device for correcting a fuel injection amount of an internal combustion engine, which performs feedback control according to an output value of an oxygen sensor provided in an exhaust pipe, and to a control apparatus for an internal combustion engine employing the device.

2. Description of the Related Art

A conventional fuel injection control apparatus for an internal combustion engine performs control with a control gain that is set larger than usual until initial inversion occurs after the start of $O_2$ feedback (e.g., see JP 2003-232248 A).

In this conventional fuel injection control apparatus for an internal combustion engine, the control gain is set larger than usual until initial inversion occurs after the start of $O_2$ feedback. The speed of following a stoichiometric air-fuel ratio (i.e., a theoretical air-fuel ratio) after the start of $O_2$ feedback is thereby increased.

Combustion is unstable and the range allowing combustion on a lean side of an air-fuel ratio A/F is narrow when an internal combustion engine is at a low temperature. For instance, although combustion is possible at an air-fuel ratio of A/F=17 or less after an internal combustion engine has warmed up, combustion is impossible at an air-fuel ratio of A/F=15 or more when an internal combustion engine is cold.

Even if the air-fuel ratio A/F is within a range allowing combustion, the torque of an internal combustion engine drastically decreases when the air-fuel ratio A/F shifts to the lean side. Therefore, there is a problem in that the RPM of an internal combustion engine sharply decreases when a large feedback gain is set to shift the air-fuel ratio A/F to the lean side at an early stage.

Furthermore, there is another problem in that misfire, which leads to engine stall in some cases, is caused when the combustion state of an internal combustion engine exceeds a combustion limit (on the lean side).

Immediately after the start of an internal combustion engine as well, combustion is unstable and the feedback is set large as in a period in which the internal combustion engine is cold. Therefore, there is a problem in that a decrease in RPM, misfire, engine stall, and the like are caused when an attempt is made to shift the air-fuel ratio to the lean side at an early stage.

The range allowing combustion on the lean side of the air-fuel ratio A/F is narrower in a low-load operation range than in a high-load operation range, and, in particular, the feedback gain is set large especially in the low-load operation range immediately after the start of an internal combustion engine as well. Therefore, there is a problem in that a decrease in RPM, misfire, engine stall, and the like are caused when an attempt is made to shift the air-fuel ratio to the lean side at an early stage.

SUMMARY OF THE INVENTION

The present invention has been made to solve the above-mentioned problems. It is a first object of the present invention to provide a control apparatus for an internal combustion engine which can prevent a decrease in RPM, misfire, and engine stall by refraining from correcting the amount of fuel to shift an air-fuel ratio A/F toward a lean side to the extent of exceeding a combustion limit when the internal combustion engine is at a low temperature.

It is a second object of the present invention to provide a control apparatus for an internal combustion engine which can prevent a decrease in RPM, misfire, and engine stall by refraining from correcting the amount of fuel to shift an air-fuel ratio A/F toward a lean side to the extent of exceeding a combustion limit immediately after the internal combustion engine has been started.

It is a third object of the present invention to provide a control apparatus for an internal combustion engine which can prevent a decrease in RPM, misfire, and engine stall by refraining from correcting the amount of fuel to shift an air-fuel ratio A/F toward a lean side to the extent of exceeding a combustion limit when the internal combustion engine operates at a low load.

According to the present invention, there is provide a control apparatus for controlling operation of an internal combustion engine, including: air-fuel ratio detecting means provided in an exhaust system of the internal combustion engine, for detecting an air-fuel ratio to be used to control operation of the internal combustion engine; RPM detecting means for detecting RPM to be used to control operation of the internal combustion engine; an intake pipe pressure sensor for detecting an intake pipe pressure to be used to control operation of the internal combustion engine; coolant temperature detecting means for detecting a coolant temperature to be used to control operation of the internal combustion engine; air-fuel ratio state determining means for determining whether the air-fuel ratio detected by the air-fuel ratio detecting means is in a rich state or in a lean state; characteristic retaining means for retaining an integral gain characteristic in which a value of an integral gain is determined by RPM and an intake pipe pressure, a proportional gain characteristic in which a value of a proportional gain is determined by RPM and an intake pipe pressure, and a coolant temperature coefficient characteristic in which a coolant temperature coefficient for correcting the integral gain is determined according to a coolant temperature; and fuel correction amount calculating means for multiplying the integral gain by the coolant temperature coefficient in calculating a correction amount of a fuel injection amount using a sign obtained from a determination result of the air-fuel ratio state determining means, the integral gain, and the proportional gain, in which the coolant temperature coefficient of the coolant temperature coefficient characteristic is set to be smaller than a constant value in a region where the coolant temperature is lower than a constant temperature.

According to the present invention, an updated value of an air-fuel ratio correction amount calculated by air-fuel ratio correction amount calculating means is calculated according to a temperature of the internal combustion engine. This updated value is set to be smaller as the temperature of the internal combustion engine lowers. Thus, the amount of fuel is not corrected to shift the air-fuel ratio A/F toward the lean side to the extent of exceeding a combustion limit when the internal combustion engine is in a combustion state. As a result, a decrease in RPM, the occurrence of misfire, the occurrence of engine stall, and the like can be prevented.

DETAILED DESCRIPTION OF THE PREFERRED EMBODIMENTS

First Embodiment

Figure 1:
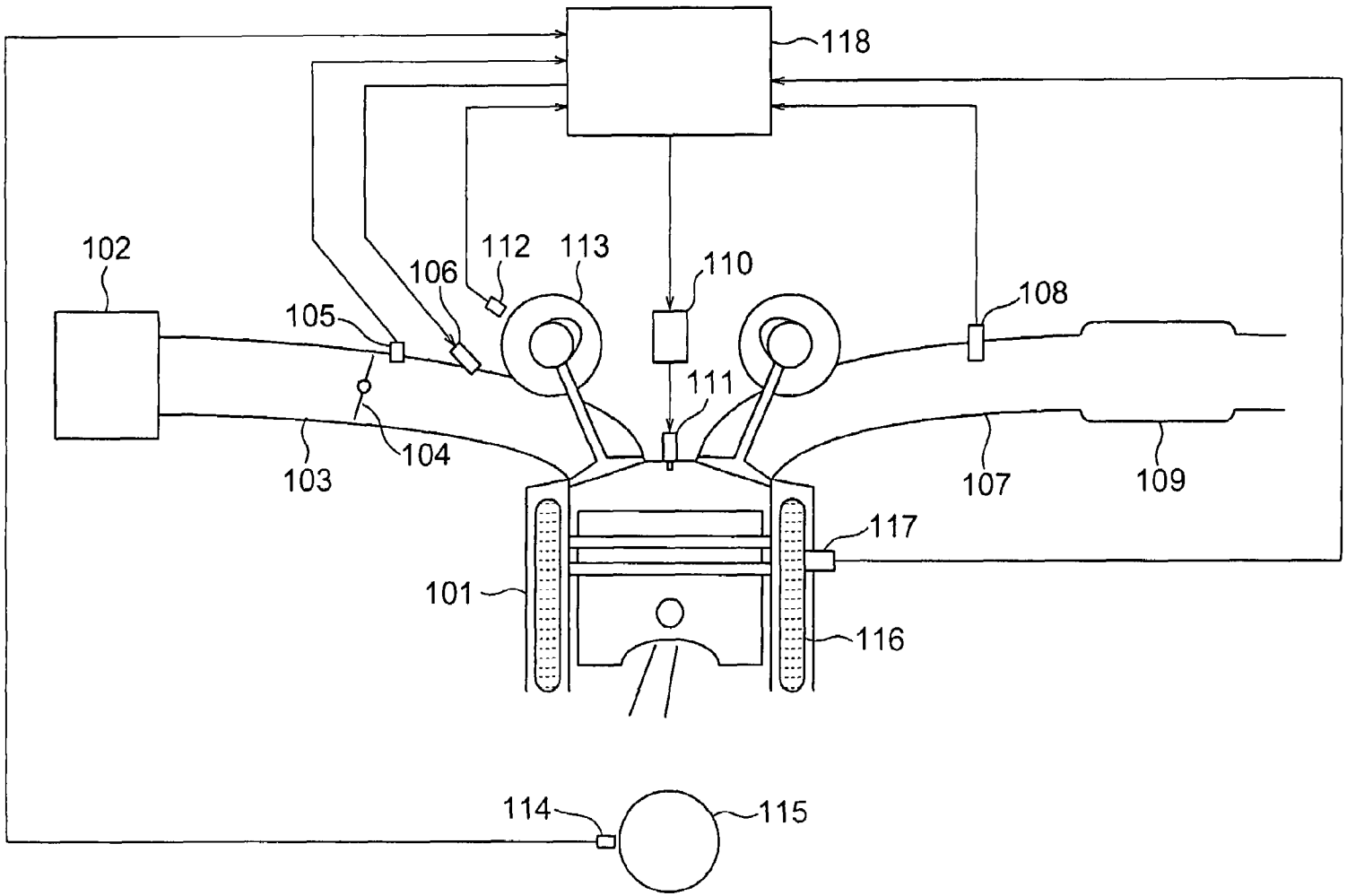
FIG. 1 is a view showing a control apparatus for an internal combustion engine according to a first embodiment of the present invention.

FIG. 1 is a view showing a control apparatus for an internal combustion engine according to the first embodiment of the present invention.

An internal combustion engine 101 is equipped with an air cleaner 102, an intake pipe 103, a throttle valve 104, a pressure sensor 105, an injector 106, an exhaust pipe 107, an $O_2$ sensor 108, a three-way catalyst 109, an ignition coil 110, an ignition plug 111, a cam angle sensor 112, a cam angle sensor plate 113, a crank angle sensor 114, a crank angle sensor plate 115, coolant 116, a coolant temperature sensor 117, and a control unit (hereinafter referred to as an "ECU") 118. The air cleaner 102 purifies air sucked by the internal combustion engine 101. The throttle valve 104 adjusts an amount of air sucked by the internal combustion engine 101. The pressure sensor 105 measures a pressure in the intake pipe 103 at a position downstream of the throttle valve 104. The injector 106 supplies fuel to air sucked by the internal combustion engine 101, thereby forming a mixture. The $O_2$ sensor 108 measures an amount of air remaining in exhaust gas discharged from the internal combustion engine 101. The three-way catalyst 109 converts harmful components contained in exhaust gas, that is, HC, CO, and NOx, into harmless components, that is, $CO_2$ and $H_2O$. The ignition coil 110 causes a high voltage to be generated in a secondary coil by supplying an electric current to a primary coil and cutting off the supply of an electric current to the primary coil. The ignition plug 111 generates a spark through the high voltage generated in the ignition coil 110. The cam angle sensor 11 generates a cam angle signal. A protrusion or a recess for causing the cam angle sensor 112 to generate a signal is formed on or in the cam angle sensor plate 113. The crank angle sensor 114 generates a crank angle signal. A protrusion or a recess for causing the crank angle sensor 114 to generate a signal is formed on or in the crank angle sensor plate 115. The coolant 116 cools the internal combustion engine 101. The coolant temperature sensor 117 detects temperature of the coolant 116. Output signals from the cam angle sensor 112, the crank angle sensor 114, the pressure sensor 105, the $O_2$ sensor 108, the coolant temperature sensor 117, and the like are inputted to the ECU 118. The ECU 118 calculates a fuel injection amount, an ignition timing, and the like based on the output signals inputted thereto, and outputs signals to the injector 106 and the ignition coil 110.

Figure 2:
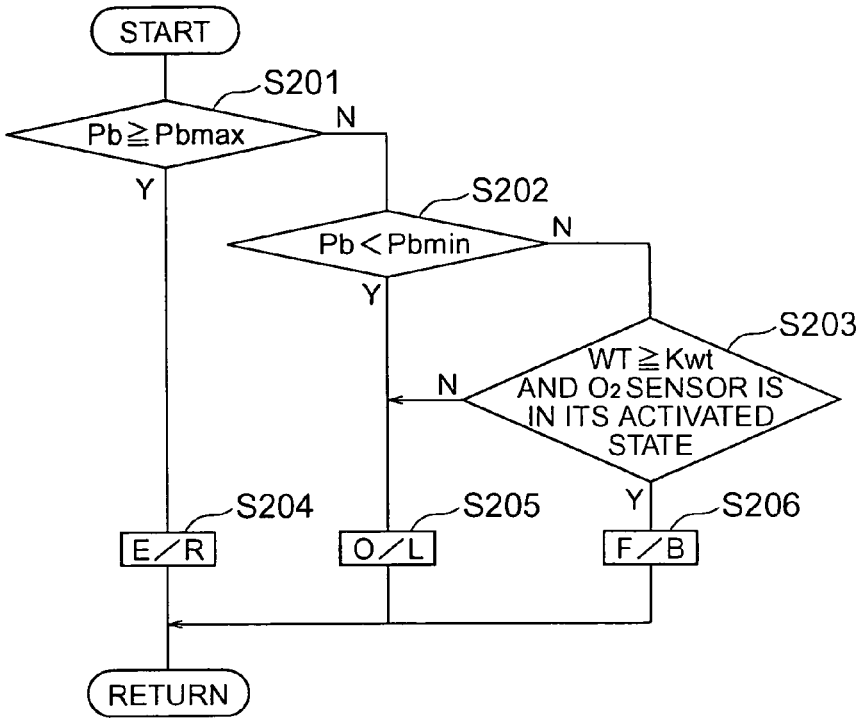
FIG. 2 is a flowchart showing a process of making a determination on a mode for calculating a fuel injection amount calculated by an ECU.

FIG. 2 is a flowchart showing a process for making a determination on a mode for calculating a fuel injection amount calculated by the ECU 118.

A control processing based on the flowchart shown in FIG. 2 is performed by the ECU 118 at, for example, each ignition timing.

Although flowcharts other than the one shown in FIG. 2 are used as well in the following description, it should be noted that a control processing based on anyone of those flowcharts is performed at each ignition timing.

The ECU 118, which is a control apparatus for controlling operation of the internal combustion engine 101, functions especially as the following means, namely, (1) air-fuel ratio state determination means, (2) characteristic retaining means, and (3) fuel correction amount calculating means. The air-fuel ratio state determination means determines whether an air-fuel ratio detected by air-fuel ratio detecting means is in a lean state or in a rich state. The characteristic retaining means retains characteristics of an integral gain and a proportional gain that are determined according to the RPM of an engine and an intake pipe pressure, and a coolant temperature coefficient characteristic in which a coolant temperature coefficient for correcting the integral gain is determined according to a temperature of the coolant 116. In calculating a correction amount of a fuel injection amount using a sign, an integral gain, and a proportional gain that are obtained from a determination result of the air-fuel ratio state determining means, the fuel correction amount calculating means multiplies the integral gain by the coolant temperature coefficient.

The characteristic retaining means may not necessarily be a memory in the ECU 118. In other words, the characteristic retaining means may be an external memory.

In Step S201, it is determined whether or not an intake pipe pressure (Pb) is equal to or higher than an upper-limit intake pipe pressure (Pbmax) in an $O_2$ feedback mode (F/B).

When it is determined in Step S201 that the intake pipe pressure (Pb) is equal to or higher than the upper-limit intake pipe pressure (Pbmax) in the $O_2$ feedback mode (F/B), the flow proceeds to Step S204.

In Step S204, it is determined that an enrichment mode (E/R) has been entered.

On the other hand, when it is determined in Step S201 that the intake pipe pressure (Pb) is not equal to or higher than the upper-limit intake pipe pressure (Pbmax) in the $O_2$ feedback mode (F/B), the flow proceeds to Step S202.

In Step S202, it is determined whether or not the intake pipe pressure (Pb) is lower than a lower-limit in take pipe pressure (Pbmin) in the $O_2$ feedback mode (F/B).

When it is determined in Step S202 that the intake pipe pressure (Pb) is lower than the lower-limit intake pipe pressure (Pbmin) in the $O_2$ feedback mode (F/B), the flow proceeds to Step S205.

In Step S205, it is determined that an open loop mode (O/L) has been entered.

When it is determined in Step S202 that the intake pipe pressure (Pb) is not lower than the lower-limit intake pipe pressure (Pbmin) in the $O_2$ feedback mode (F/B), the flow proceeds to Step S203.

In Step S203, it is determined whether or not a coolant temperature (WT) is equal to or higher than a coolant temperature (Kwt) for performing $O_2$ feedback and the $O_2$ sensor 108 is in its activated state.

When it is determined in Step S503 that the coolant temperature (WT) is equal to or higher than the coolant temperature (Kwt) for performing $O_2$ feedback and the $O_2$ sensor 108 is in its activated state, the flow proceeds to Step S206.

In Step S206, the $O_2$ feedback mode (F/B) is entered.

On the other hand, when it is determined in Step S203 that the coolant temperature (WT) is not equal to or higher than the coolant temperature (Kwt) for performing $O_2$ feedback or that the $O_2$ sensor 108 is not in its activated state, the open loop mode (O/L) is entered.

It is determined whether or not the $O_2$ sensor 108 is in its activated state, depending on whether or not an output voltage of the $O_2$ sensor 108 is equal to or higher than a threshold (0.45 V).

The open loop mode (O/L) is a control mode in which an output from the $O_2$ sensor 108 is not feedback-controlled. In the open loop mode (O/L), a fuel injection amount is controlled according to a base map of a fuel injection amount which is determined by RPM and load of the internal combustion engine 101.

Figure 3:
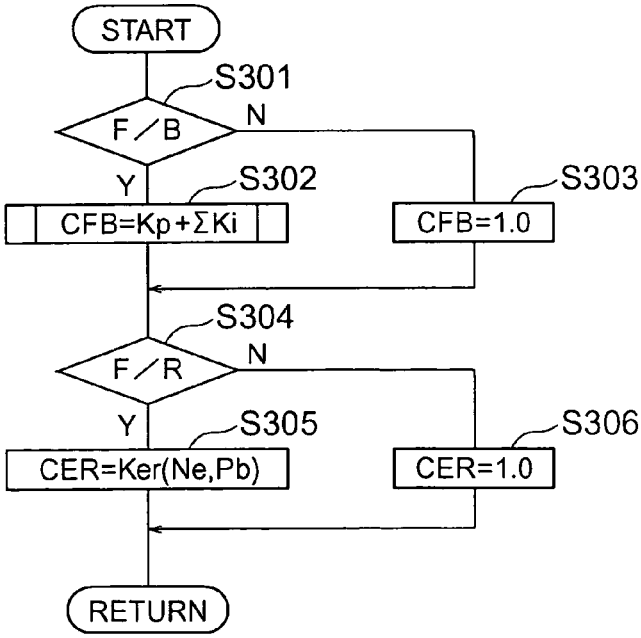
FIG. 3 is a flowchart showing a process of deriving a correction amount of the fuel injection amount calculated by the ECU.

FIG. 3 is a flowchart showing a process of deriving a correction amount of a fuel injection amount calculated by the ECU 118.

In Step S301, it is determined whether or not the $O_2$ feedback mode (F/B) has been entered.

When it is determined in Step S301 that the $O_2$ feedback mode (F/B) has been entered, the flow proceeds to Step S302.

In Step S302, a proportional correction amount (Kp) and an integral correction amount (SKi) are summed to obtain a fuel correction amount (CFB).

A method of calculating the fuel correction amount (CFB) will be described later.

When it is determined in Step S301 that the $O_2$ feedback mode (F/B) has not been entered, the flow proceeds to Step S303.

In Step S303, the fuel correction amount (CFB) is set to 1.0.

In Step S304, it is determined whether or not the enrichment mode (E/R) has been entered.

When it is determined in Step S304 that the enrichment mode (E/R) has been entered, the flow proceeds to Step S305.

In Step S305, referring to a map of a correction amount of a fuel injection amount which is available as a combination of RPM (Ne) and an intake pipe pressure (Pb), a value corresponding to the RPM (Ne) and an intake pipe pressure (Pb) at that moment is set as an enrichment correction amount (CER).

This map, which represents a correction amount for correcting an air-fuel ratio toward the rich side based on RPM and an intake pipe pressure, is known and therefore will not be described below.

On the other hand, when it is determined in Step S304 that the enrichment mode (E/R) has not been entered, the flow proceeds to Step S306.

In Step S306, the enrichment correction amount (CER) is set to 1.0.

Figure 4:
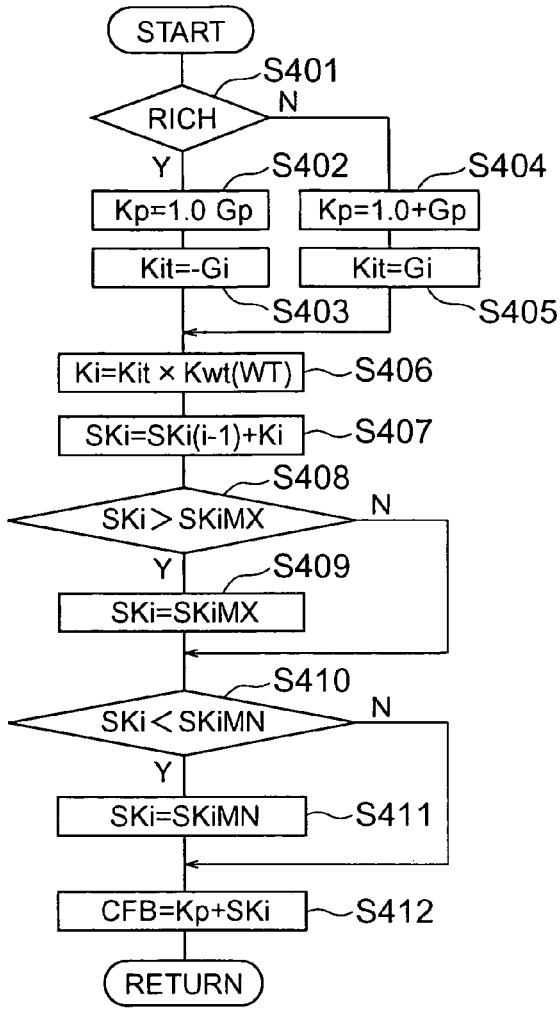
FIG. 4 is a flowchart showing the concrete contents of a process for calculating an $O_2$ feedback correction amount (CFB) in Step of FIG. 3.

FIG. 4 is a flowchart showing the concrete contents of a process for calculating the $O_2$ feedback correction amount (CFB) in Step S302 of FIG. 3. That is, the processing shown in FIG. 4 is performed by the ECU 118.

In Step S401, it is determined based on an output signal from the $O_2$ sensor 108 whether or not the air-fuel ratio is in the rich state (RICH).

The output from the $O_2$ sensor 108 is approximately equal to 1 V when the air-fuel ratio of exhaust gas is rich with respect to the stoichiometric air-fuel ratio, and is approximately equal to 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S401, based on the output signal from the $O_2$ sensor 108, that the air-fuel ratio is rich (RICH), the flow proceeds to Step S402.

In Step S402, a proportional value (Kp) is calculated using the following equation.

$$Kp=1.0-Gp$$

Here, Gp represents a proportional gain.

In a subsequent step S403, an integral gain (Kit) is set using the following equation.

$$\mathrm{Kit}=-Gi$$

When it is determined in Step S401, based on the output signal from the $O_2$ sensor 108, that the air-fuel ratio is not in the rich state (RICH), the flow proceeds to Step S404.

In Step S404, a proportional value (Kp) is calculated using the following equation.

$$Kp=1.0+Gp$$

Here, Gp represents a proportional gain.

In a subsequent step S405, the integral gain (Kit) is set to Gi.

In a subsequent step S406, the integral gain (Kit) is multiplied by a coolant temperature coefficient (Kwt(WT)) to calculate the last integral gain (Ki). The coolant temperature coefficient (Kwt(WT)) will be described later with reference to FIG. 7.

Furthermore, in Step S407, the second last integral value (SKi(i−1)) and the final integral gain (Ki) are summed to obtain an integral value (SKi).

In a subsequent step S408, it is determined whether or not the integral value (SKi) is larger than an integral upper limit (SKiMX).

When it is determined in Step S408 that the integral value (SKi) is larger than the integral upper limit (SKiMX), the flow proceeds to Step S409.

In Step S409, the integral value (SKi) obtained in Step S407 is set as the integral upper limit (SKiMX).

In a subsequent step S410, it is determined whether or not the integral value (SKi) is smaller than an integral lower limit (SKiMN).

When it is determined in Step S410 that the integral value (SKi) is smaller than the integral lower limit (SKiMN), the flow proceeds to Step S411.

In Step S411, the integral value (SKi) is set to the integral lower limit (SKiMN).

Furthermore, in a subsequent step S412, the $O_2$ feedback correction amount (CFB) is set to the sum of the proportional value (Kp) and the integral value (SKi).

When it is determined in Step S408 that the integral value (SKi) is equal to or smaller than the integral upper limit (SKIMX), the flow proceeds to Step S410.

When it is determined in Step S410 that the integral value (SKi) is equal to or larger than the integral lower limit (SKIMN), the flow proceeds to Step S412.

Figure 5:
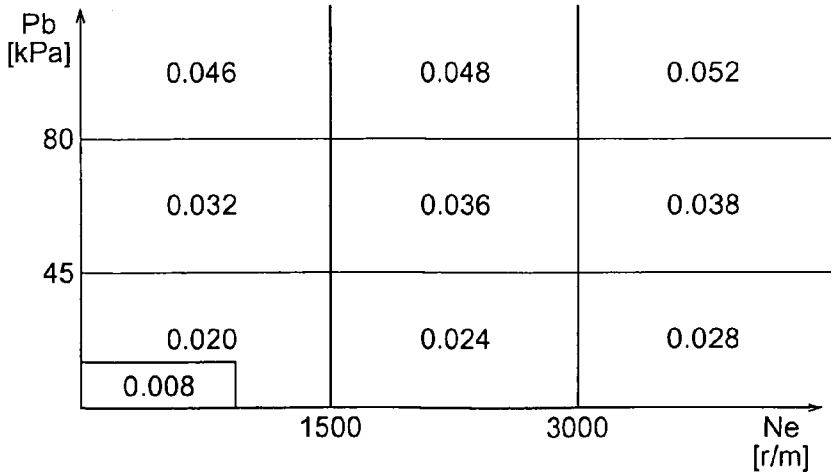
FIG. 5 is a table showing a proportional gain (Gp) used as a value corresponding to RPM (Ne) and an intake pipe pressure (Pb)

FIG. 5 is a table showing the proportional gain (Gp) used as a value corresponding to the RPM (Ne) and the intake pipe pressure (Pb).

Figure 6:
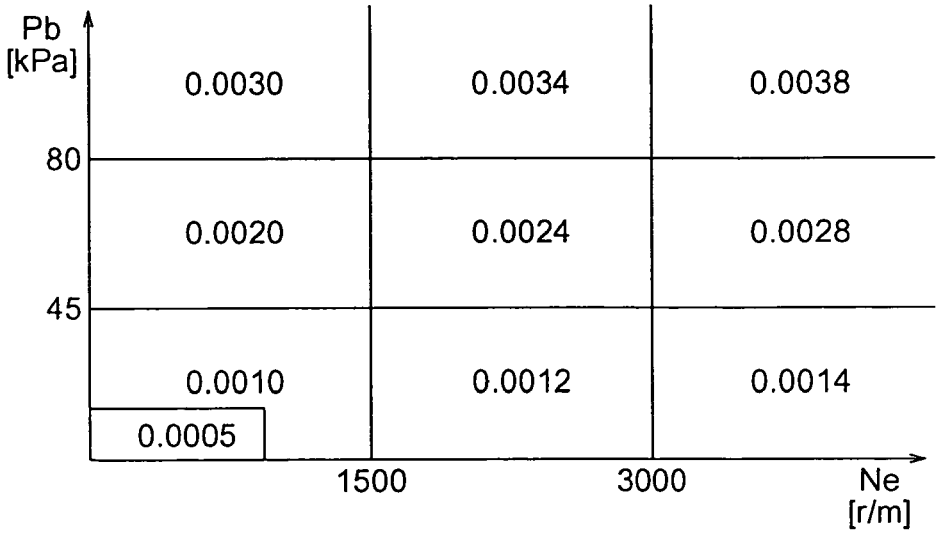
FIG. 6 is a table showing an integral gain (Gi) used as a value corresponding to RPM (Ne) and an intake pipe pressure (Pb)

FIG. 6 is a table showing the integral gain (Gi) used as a value corresponding to the RPM (Ne) and the intake pipe pressure (Pb).

Thus, the values of the proportional gain (Gp) and the integral gain (Gi) are set for each of the zones that are separated from one another according to the RPM (Ne) and the intake pipe pressure (Pb), and those values of the proportional gain (Gp) and the integral gain (Gi) which correspond to the conditions on the RPM (Ne) and the intake pipe pressure (Pb) are selected. When an output value of a throttle sensor indicates that the throttle valve 104 is substantially fully closed, it is determined that the internal combustion engine 101 is in its idling state, so an idling gain is used.

The idling gain is a value in the lower left block (which is adjacent to the origin) in each of the characteristics shown in the tables of FIGS. 5 and 6.

Figure 7:
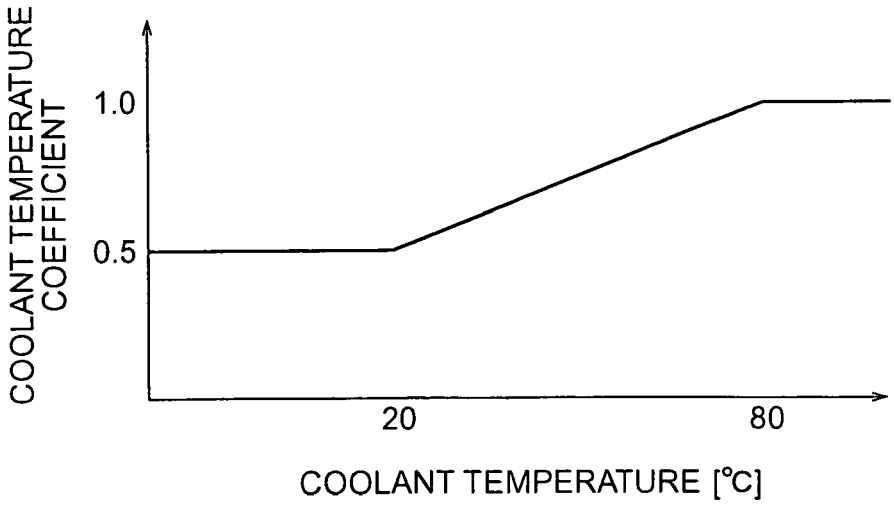
FIG. 7 is a characteristic diagram showing a coolant temperature characteristic of a coolant temperature coefficient (Kwt(WT)) by which an integral gain (Kit) is multiplied.

FIG. 7 is a characteristic diagram showing a characteristic of the coolant temperature coefficient (Kwt(WT)), by which the integral gain (Kit) is multiplied, with respect to a coolant temperature.

In a region of low coolant temperatures, the coolant temperature coefficient (Kwt(WT)) is set to be small (to a first level (0.5)), so the final integral gain (Ki) that has been multiplied by the coolant temperature coefficient (Kwt (WT)) assumes a small value. As the coolant temperature rises, the coolant temperature coefficient (Kwt(WT)) is linearly changed over to a second level (1.0), which is larger than the first level, in a predetermined coolant temperature range (between 20° C. and 80° C.). Alternatively, the coolant temperature coefficient (Kwt (WT)) may be changed over nonlinearly. Also, the coolant temperature coefficient (Kwt (WT)) may be changed over to the second level, which is larger than the first level, at a predetermined coolant temperature.

In order to adjust an injector open-valve time (Ti) to regulate an amount of fuel supplied to the intake pipe 103, the injector open-valve time (Ti) corresponding to the amount of supplied fuel is calculated using the following equation.

$$Ti=(Pb\times Kp2t\times K1\times CFB)+(Tacc-Tdec)+Td$$

Here, Ti represents an injector open-valve time [msec], that Pb represents an intake pipe pressure [kPa], that Kp2t represents an intake pipe pressure/open-valve time conversion coefficient [msec/kPa], that K1 represents various correction coefficients (for enrichment correction, warm-up correction, and the like), that CFB represents an $O_2$ feedback coefficient, that Tacc represents an acceleration increase amount [msec], that Tdec represents a decrease in RPM [msec], and that Td represents a dead time [msec].

The fuel supplied to the intake pipe 103 is mixed with sucked air, burnt in the internal combustion engine 101, and then discharged to the exhaust pipe 107. Then, the $O_2$ sensor 108 measures an amount of oxygen remaining in the exhaust gas.

In the $O_2$ feedback mode (F/B), an amount of increase or decrease in the final integral gain (Ki) is adjusted based on an output value of the $O_2$ sensor 108, by means of the $O_2$ feedback correction coefficient (CFB).

Figure 8:
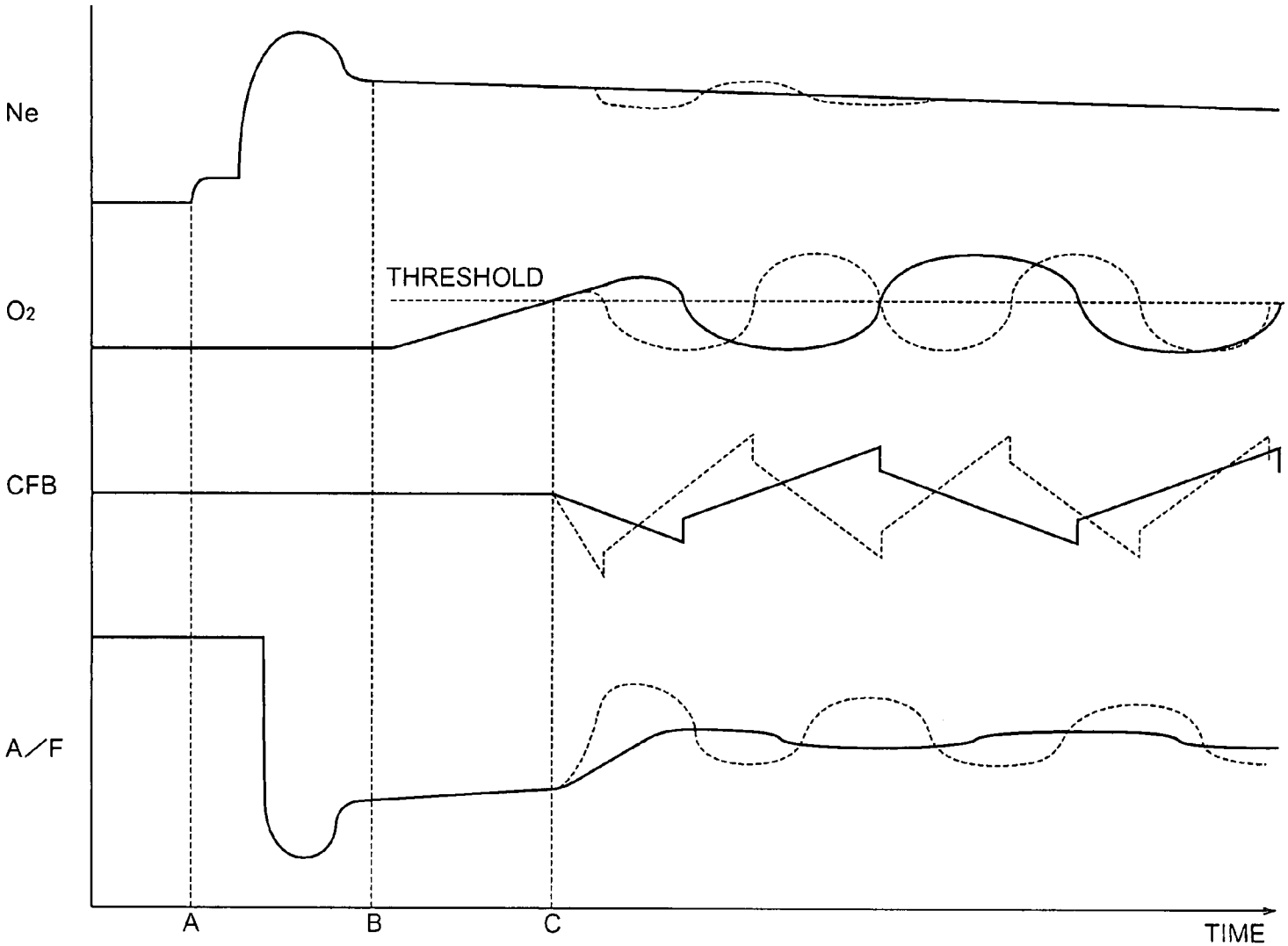
FIG. 8 is a time chart showing how the RPM (Ne), an amount of remaining oxygen, an $O_2$ feedback correction coefficient (CFB), and a change of an air-fuel ratio A/F when an internal combustion engine is started at a coolant temperature of 20° C.

FIG. 8 is a time chart showing how the RPM (Ne), the amount of remaining oxygen, the $O_2$ feedback correction coefficient CFB, and the air-fuel ratio A/F change when the internal combustion engine 101 is started at a coolant temperature of 20° C.

The internal combustion engine 101 is started at a time point A, and cylinders thereof are identified based on outputs from the crank angle sensor 114 and the cam angle sensor 112. After the cylinders have been identified, fuel is supplied to each of the cylinders and ignited. As a result, the operation of the internal combustion engine 101 is started.

The RPM of the internal combustion engine 101 is stabilized at a time point B. The $O_2$ sensor 108 does not generate a correct output unless its temperature has risen to a certain temperature, so the air-fuel ratio A/F is on the rich side due to warm-up correction. Thus, as the temperature of the $O_2$ sensor 108 rises, the output therefrom rises as well.

When the output from the $O_2$ sensor 108 exceeds a threshold at a time point C, the ECU 118 determines that the $O_2$ sensor 108 has reached a temperature allowing generation of a correct output value and has been activated.

$O_2$ feedback control is started as soon as the ECU 118 makes this determination.

While broken lines indicate characteristics in the case where the conventional control apparatus for the internal combustion engine performs control, solid lines indicate characteristics in the case where the control apparatus for the internal combustion engine according to the present invention performs control.

In the case of conventional control (the broken lines), after $O_2$ feedback control has been started, the integral gain of $O_2$ feedback is set large until initial inversion occurs. When the internal combustion engine is cold, the integral gain is too large, so the air-fuel ratio A/F is too lean. As a result, the RPM of the internal combustion engine decreases.

A lean limit of the air-fuel ratio A/F allowing combustion is lower when the internal combustion engine is cold than when the internal combustion engine is being warmed up. When a combustion limit is exceeded, a more drastic decrease in RPM or engine stall may be caused.

On the other hand, in the case of control according to the present invention (the solid lines), the integral gain of $O_2$ feedback is made smaller than the value at the time when the internal combustion engine 101 is being warmed up, thereby eliminating overcorrection toward the lean side. As a result, it is possible to make the air-fuel ratio A/F lean, and to restrain the RPM of the internal combustion engine 101 from decreasing drastically or the internal combustion engine 101 from stalling.

As described above, the integral gain of $O_2$ feedback is corrected according to a coolant temperature which corresponds to an engine temperature, and is set to be smaller when the coolant temperature is low than when the coolant temperature is high. Thus, the air-fuel ratio A/F and the behavior of engine rotation can be stabilized even at a low temperature, that is, even with a low combustion limit.

Second Embodiment

Figure 9:
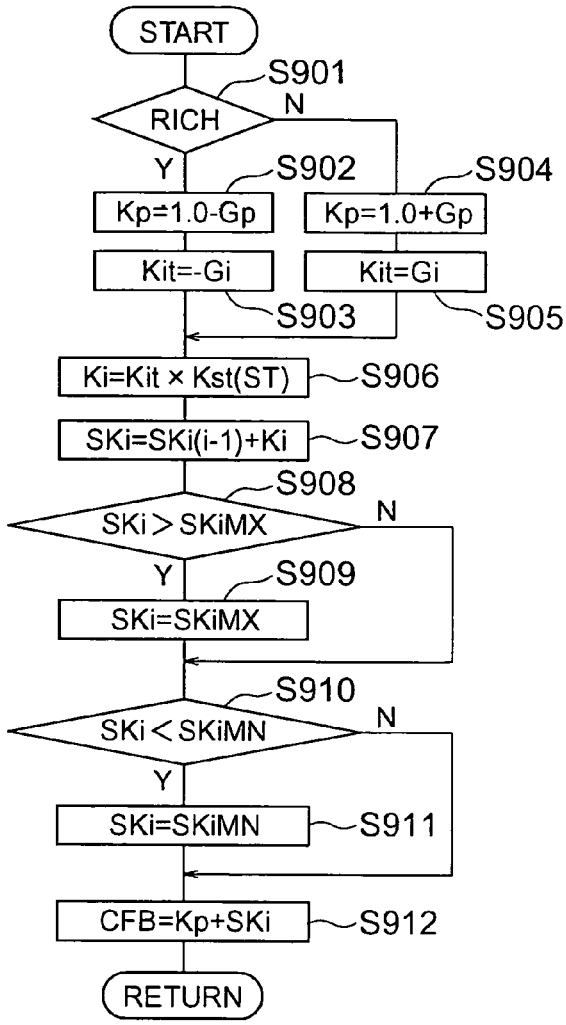
FIG. 9 is a flowchart showing the contents of a process for calculating an $O_2$ feedback correction amount (CFB) in a control apparatus for an internal combustion engine according to a second embodiment of the present invention.

FIG. 9 is a flowchart showing the contents of a process for calculating an $O_2$ feedback correction amount (CFB) in a control apparatus for an internal combustion engine according to the second embodiment of the present invention. A method of calculating the $O_2$ feedback correction amount (CFB) shown in FIG. 9 is different from the method of calculating the $O_2$ feedback correction amount (CFB) according to the first embodiment of the present invention.

The ECU 118, which is the control apparatus for controlling operation of the internal combustion engine according to the second embodiment of the present invention, functions especially as the following means:

(1) air-fuel ratio state determining means;

(2) characteristic retaining means; and (3) fuel correction amount calculating means.

The air-fuel ratio state determining means determines whether an air-fuel ratio detected by the air-fuel ratio detecting means is in a rich state or in a lean state. The characteristic retaining means retains an integral gain characteristic and a proportional gain characteristic in which the values of an integral gain and a proportional gain are determined by RPM and an intake pipe pressure, and an elapsed time coefficient characteristic in which an elapsed time coefficient for correcting the integral gain is determined by a post-start elapsed time. The fuel correction amount calculating means multiplies the integral gain by the elapsed time coefficient in calculating a correction amount of a fuel injection amount using a sign obtained according to a determination result of the air-fuel ratio state determining means, the integral gain, and the proportional gain.

The characteristic retaining means need not be a memory in the ECU 118 but may be an external memory.

As shown in FIG. 9, first in Step S901, it is determined based on an output signal from the $O_2$ sensor 108 whether or not the air-fuel ratio A/F is rich (RICH).

The output from the $O_2$ sensor 108 is approximately 1 V when the air-fuel ratio of exhaust gas is rich with respect to the stoichiometric air-fuel ratio, and is approximately 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S901 that the air-fuel ratio A/F is rich (RICH) because the output from the $O_2$ sensor 108 is larger than the threshold (0.45 V), the flow proceeds to Step S902.

In Step S902, a proportional value (Kp) is calculated using the following equation.

$$Kp=1.0-Gp$$

Here, Gp represents a proportional gain.

In Step S903, an integral gain (Kit) is set using the following equation.

$$\mathrm{Kit}=-Gi$$

On the other hand, when it is determined in Step S901 that the air-fuel ratio A/F is lean because the output from the $O_2$ sensor 108 is equal to or smaller than the threshold (0.45 V), the flow proceeds to Step S904.

In Step S904, a proportional gain (Kp) is calculated using the following equation.

$$Kp=1.0+Gp$$

Here, Gp represents a proportional gain.

In a subsequent step S905, the integral gain (Kit) is set to Gi.

Furthermore, in a subsequent step S906, the integral gain (Kit) is multiplied by a post-start elapsed time correction coefficient (Kst(ST)) to obtain the last integral gain (Ki).

In Step S907, the second last integral value (SKi(i−1)) and the final integral gain (Ki) are summed to obtain an integral value (SKi).

Here, the second last integral value (SKi(i−1)) means an integral value obtained last time in an engine control processing that is performed at each ignition timing.

In a subsequent step S908, it is determined whether or not the integral value (SKi) is larger than an integral upper limit (SKiMX).

When it is determined in Step S908 that the integral value (SKi) is larger than the integral upper limit (SKiMX), the flow proceeds to Step S909.

In Step S909, the integral value (SKi) is set to the integral upper limit (SKiMX).

Furthermore, in a subsequent step S910, it is determined whether or not the integral value (SKi) is smaller than an integral lower limit (SKiMN).

When it is determined in Step S910 that the integral value (SKi) is smaller than the integral lower limit (SKiMN), the flow proceeds to Step S911.

In Step S911, the integral value (SKi) is set to the integral lower limit (SKiMN).

Furthermore, in a subsequent step S912, the proportional value (Kp) and the integral value (SKi) are summed to obtain the $O_2$ feedback correction amount (CFB).

When it is determined in Step S908 that the integral value (SKi) is equal to or smaller than the integral upper limit (SKIMX), the flow proceeds to Step S910.

When it is determined in Step S910 that the integral value (SKi) is equal to or larger than the integral lower limit (SKiMN), the flow proceeds to Step S912.

Figure 10:
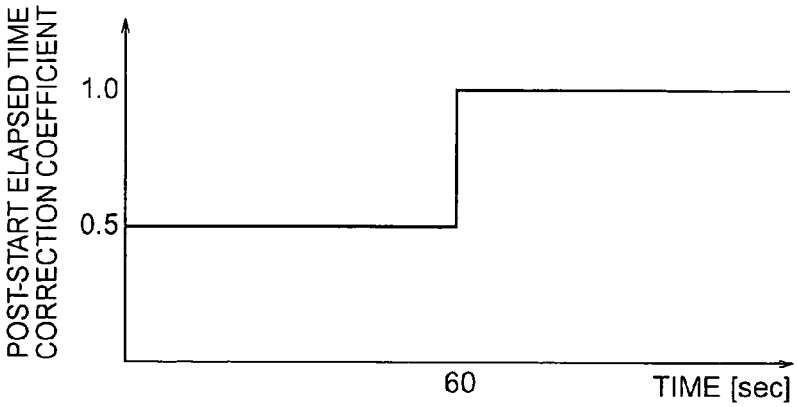
FIG. 10 is a characteristic diagram showing a characteristic of a post-start elapsed time correction coefficient, by which an integral gain (Kit) is multiplied, with respect to an elapsed time.

FIG. 10 is a characteristic diagram showing a characteristic of a post-start elapsed time correction coefficient, by which the integral gain (Kit) is multiplied, with respect to an elapsed time.

The correction coefficient is set to be small (to a first level (0.5)) in a region where the post-start elapsed time is not very long (within 60 seconds). The correction coefficient is set to a second level (1.0, that is, with no correction), which is larger than the first level, after a predetermined post-start elapsed time (60 seconds) has passed.

Figure 11:
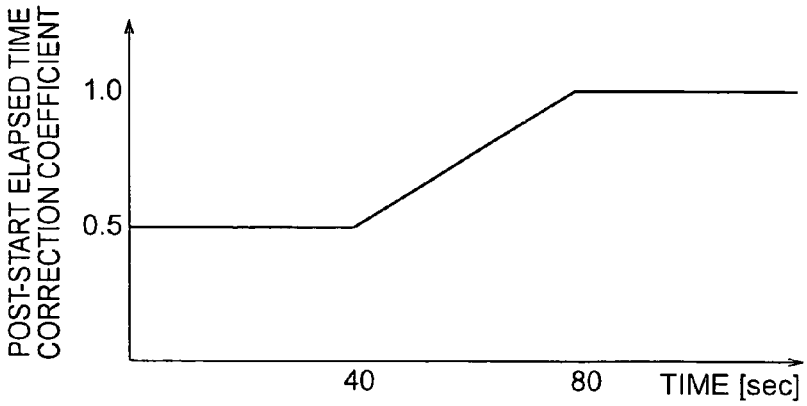
FIG. 11 is a characteristic diagram showing a characteristic of a post-start elapsed time correction coefficient, by which the integral gain (Kit) is multiplied, with respect to an elapsed time.

FIG. 11 is a characteristic diagram showing a characteristic of a post-start elapsed time correction coefficient, by which the integral gain (Kit) is multiplied, with respect to an elapsed time.

According to the characteristic shown in FIG. 11, unlike the characteristic shown in FIG. 10, the correction coefficient gradually increases as time elapses after the start of the engine. The characteristic indicating how the post-start elapsed time correction coefficient, by which the integral gain (Kit) is multiplied, changes with respect to an elapsed time is not limited to the characteristic shown in FIG. 10. It is also possible to adopt the characteristic as shown in FIG. 11 in which the post-start elapsed time correction coefficient is linearly changed over to the second level, which is larger than the first level. Alternatively, the post-start elapsed time correction coefficient may be changed over nonlinearly.

As described above, the integral gain of $O_2$ feedback is corrected depending on the time that has elapsed after the start of the engine. That is, the integral gain of $O_2$ feedback is set to be smaller when only a short time has elapsed after the start of the engine than when a sufficiently long time has elapsed after the start of the engine. As a result, the air-fuel ratio A/F and the behavior of engine rotation can be stabilized even immediately after the start of the engine, that is, even with a low combustion limit.

Third Embodiment

Figure 12:
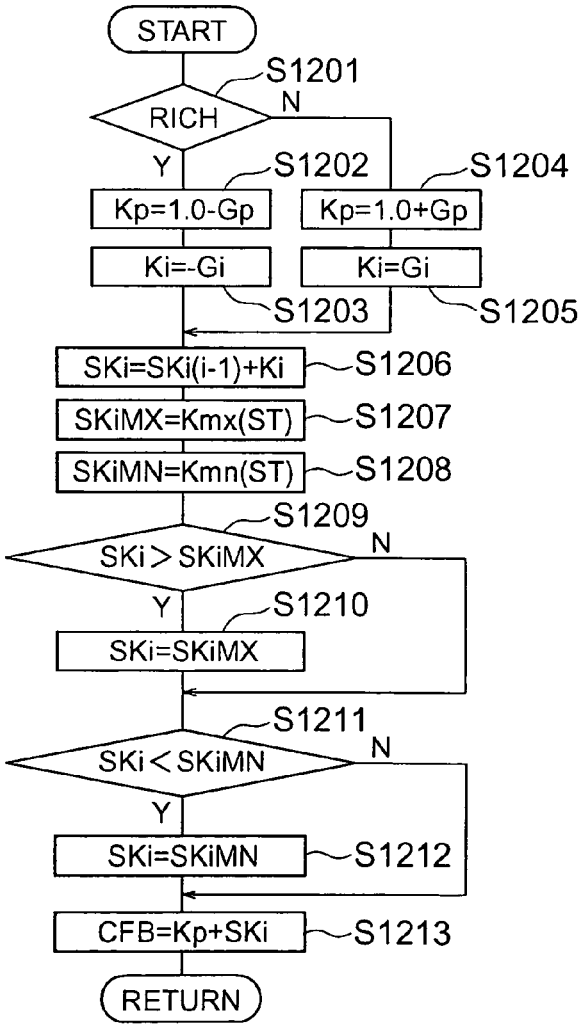
FIG. 12 is a flowchart showing the contents of a process for calculating an $O_2$ feedback correction amount (CFB) in a control apparatus for an internal combustion engine according to a third embodiment of the present invention.

FIG. 12 is a flowchart showing the contents of a process for calculating an $O_2$ feedback correction amount (CFB) in a control apparatus for an internal combustion engine according to the third embodiment of the present invention.

As shown in FIG. 12, in Step S1201, it is determined based on an output signal from the $O_2$ sensor 108 whether or not the air-fuel ratio A/F is rich (RICH).

The output from the $O_2$ sensor 108 is approximately 1 V when the air-fuel ratio of exhaust gas is rich with respect to the stoichiometric air-fuel ratio, and is approximately 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S1201, based on the output signal from the $O_2$ sensor 108, that the air-fuel ratio A/F is rich, the flow proceeds to Step S1202.

In Step S1202, a proportional value (Kp) is obtained using the following equation.

$$Kp=1.0-Gp$$

Here, Gp represents a proportional gain.

In Step S1203, an integral gain (Kit) is set using the following equation.

$$\mathrm{Kit}=-Gi$$

On the other hand, when it is determined in Step S1201 that the air-fuel ratio A/F is lean because the output from the $O_2$ sensor 108 is equal to or smaller than the threshold (0.45 V), the flow proceeds to Step S1204.

In Step S1204, a proportional value (Kp) is obtained using the following equation.

$$Kp=1.0+Gp$$

Here, Gp represents a proportional gain.

In a subsequent step S1205, the integral gain (Kit) is set to Gi.

Furthermore, in a subsequent step S1206, the second last integral value (SKi(i−1)) and the integral gain (Ki) are summed to obtain an integral value (SKi).

In Step S1207, an integral upper limit (SKIMX) is obtained referring to a map of post-start elapsed time (Kmx(ST)).

In a subsequent step S1208, an integral lower limit (SKIMN) is obtained referring to a map of post-start elapsed time (Kmn(ST)).

Figure 13:
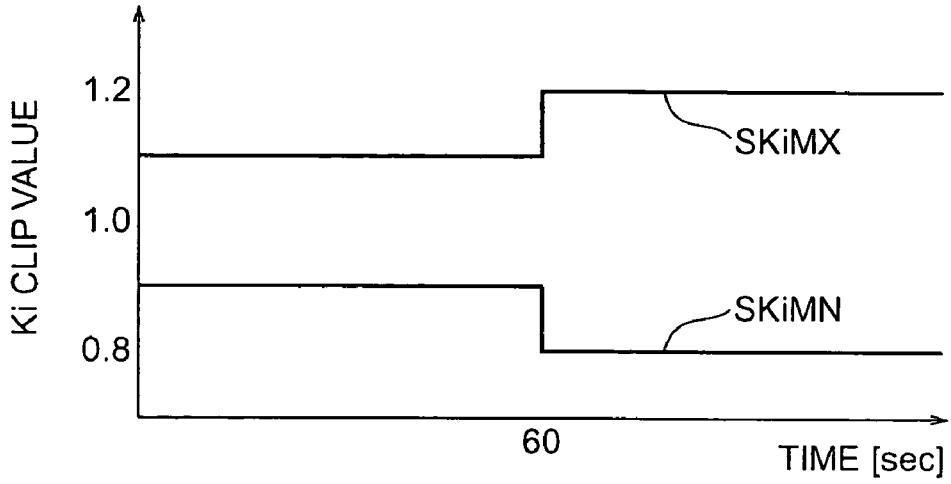
FIG. 13 is a characteristic diagram showing characteristics of an integral upper limit (SkiMX) and an integral lower limit (SkiMN) with respect to a post-start elapsed time.
Figure 14:
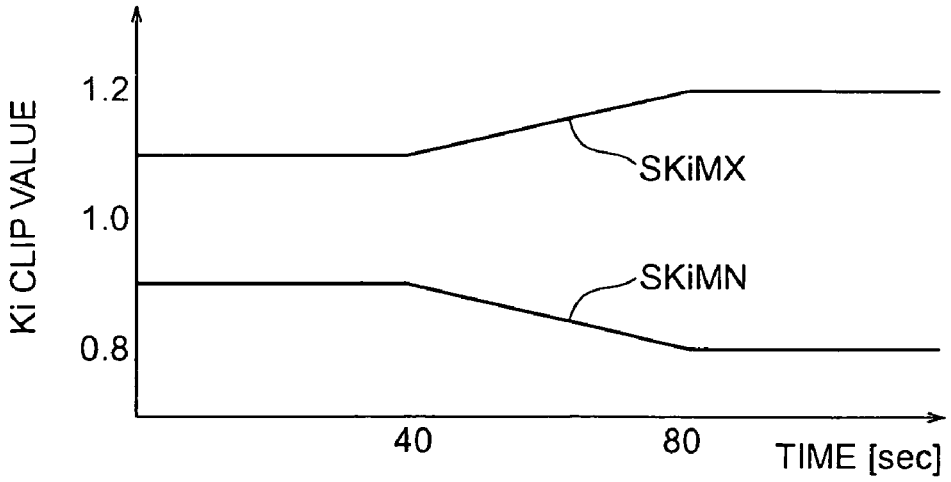
FIG. 14 is a characteristic diagram showing characteristics of the integral upper limit (SkiMX) and the integral lower limit (SkiMN) with respect to a post-start elapsed time.

FIGS. 13 and 14 each are a characteristic diagram showing the characteristics of the integral upper limit (SKIMX) and the integral lower limit (SKIMN) with respect to a post-start elapsed time.

Furthermore, in a subsequent step S1209, it is determined whether or not the integral value (SKi) is larger than the integral upper limit (SKiMX).

When it is determined in Step S1209 that the integral value (SKi) is larger than the integral upper limit (SKiMX), the flow proceeds to Step S1210.

In Step S1210, the integral value (SKi) is set to the integral upper limit (SKiMX).

In a subsequent step S1211, it is determined whether or not the integral value (SKi) is smaller than the integral lower limit (SKiMN).

When it is determined in Step S1211 that the integral value (SKi) is smaller than the integral lower limit (SKiMN), the flow proceeds to Step S1212.

In Step S1212, the integral value (SKi) is set to the integral lower limit (SKiMN).

In Step S1213, the $O_2$ feedback correction amount (CFB) is set to the sum of the proportional value (Kp) and the integral value (SKi).

FIG. 13 is a characteristic diagram showing characteristics of set values of the integral upper limit (SKIMX) and the integral lower limit (SKIMN) with respect to a time after the start of the engine.

As shown in FIG. 13, the range between the integral upper limit (SKIMX) and the integral lower limit (SKIMN) is set narrow in a region where a sufficient length of time has not elapsed after the start of the engine (within 60 seconds after the start of the engine), and is set wide after a predetermined post-start elapsed time has passed (60 seconds or more after the start of the engine).

That is, the ECU 118 functioning as the fuel correction amount calculating means functions as fuel correction amount calculating means that calculates a gain for obtaining a correction amount of a fuel injection amount using characteristics of an integral upper limit and an integral lower limit in integral calculation. According to those characteristics, as the coolant temperature rises or as time elapses after the start of the engine, the integral upper limit in integral calculation is increased to a second upper-limit level, which is higher than a first upper-limit level, and the integral lower limit in integral calculation is reduced to a second lower-limit level, which is lower than a first lower-limit level.

The characteristic retaining means for retaining the characteristics may be a memory in the ECU 118 or a memory outside the ECU 118.

FIG. 14 is a characteristic diagram showing characteristics of set values of the integral upper limit (SKiMX) and the integral lower limit (SKiMN) with respect to an elapsed time after the start of the engine. The characteristics of FIG. 14 are different from those of FIG. 13 in that the characteristics show a transient region where the range between the integral upper limit (SKiMX) and the integral lower limit (SKiMN) is gradually increased from a narrow range to a wide range.

By using the characteristics, which show the transient region, of set values of the integral upper limit (SKiMX) and the integral lower limit (SKiMN) with respect to an elapsed time after the start of the engine, a finer control processing can be performed.

As described above, with the control apparatus for the internal combustion engine according to the third embodiment of the present invention, the range between the upper limit and the lower limit of the integral gain of the $O_2$ feedback correction coefficient is changed according to the elapsed time after the start of the engine. Thus, the air-fuel ratio A/F and the behavior of engine rotation can be stabilized by setting the range between the upper limit and the lower limit of the integral gain to be narrow when a sufficient length of time has not elapsed after the start of the engine.

Fourth Embodiment

Figure 15:
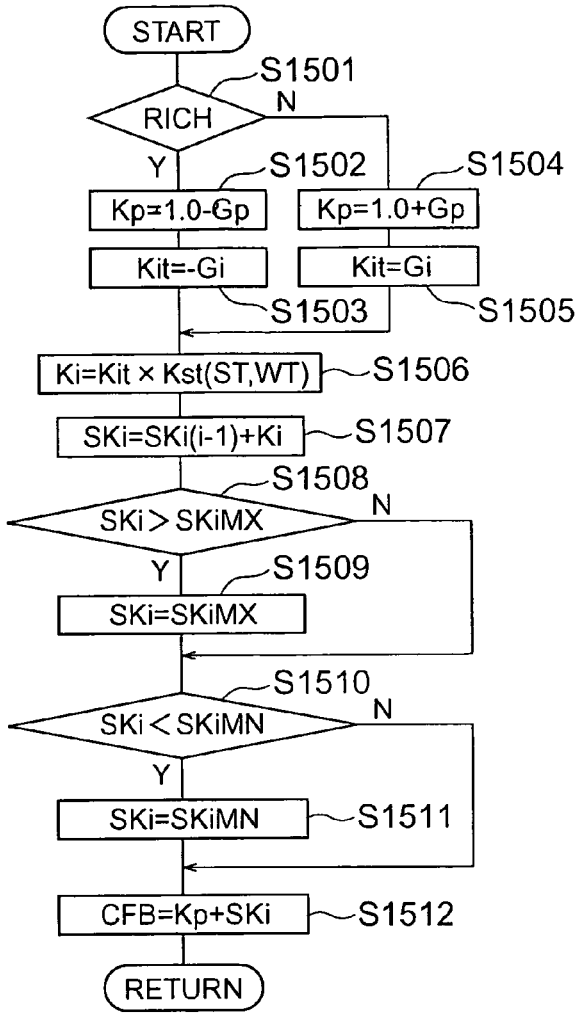
FIG. 15 is a flowchart showing the contents of a process for calculating an $O_2$ feedback correction amount (CFB) in a control apparatus for an internal combustion engine according to a fourth embodiment of the present invention.

FIG. 15 is a flowchart showing the contents of a process for obtaining an $O_2$ feedback correction amount (CFB) in a control apparatus for an internal combustion engine according to the fourth embodiment of the present invention.

As shown in FIG. 15, in Step S1501, it is determined based on an output signal from the $O_2$ sensor 108 whether or not the air-fuel ratio A/F is rich (RICH).

The output from the $O_2$ sensor 108 is approximately 1 V when the air-fuel ratio of exhaust gas is rich with respect to the stoichiometric air-fuel ratio, and is approximately 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S1501, based on the output signal of the $O_2$ sensor 108, that the air-fuel ratio A/F is rich, the flow proceeds to Step S1502.

In Step S1502, a proportional value (Kp) is obtained using the following equation.

$$Kp=1.0-Gp$$

Here, Gp represents a proportional gain.

In a subsequent step S1503, an integral gain (Kit) is set using the following equation.

$$\mathrm{Kit}=-Gi$$

On the other hand, when it is determined in Step S1501 that the air-fuel ratio A/F is lean because the output from the $O_2$ sensor 108 is equal to or smaller than the threshold (0.45 V), the flow proceeds to Step S1504.

In Step S1504, a proportional value (Kp) is obtained using the following equation.

$$Kp=1.0+Gp$$

Here, Gp represents a proportional gain.

In a subsequent step S1505, the integral gain (Kit) is set to Gi.

Furthermore, in a subsequent step S1506, the integral gain (Kit) is multiplied by a post-start correction coefficient (Kst(ST, WT)) to obtain the last integral gain (Ki).

In Step S1507, the second last integral value (SKi (i−1)) and the final integral gain (Ki) are summed to obtain an integral value (SKi).

In a subsequent step S1508, it is determined whether or not the integral value (SKi) is larger than an integral upper limit (SKiMX).

When it is determined in Step S1508 that the integral value (SKi) is larger than the integral upper limit (SKiMX), the flow proceeds to Step S1509.

In Step S1509, the integral value (SKi) is set to the integral upper limit (SKiMX).

In a subsequent step S1510, it is determined whether or not the integral value (SKi) is smaller than an integral lower limit (SKiMN).

When it is determined in Step S1510 that the integral value (SKi) is smaller than the integral lower limit (SKiMN), the flow proceeds to Step S1511.

In Step S1511, the integral value (SKi) is set to the integral lower limit (SKiMN).

In a subsequent step S1512, an $O_2$ feedback correction amount (CFB) is set to the sum of the proportional value (Kp) and the integral value (SKi).

Figure 16:
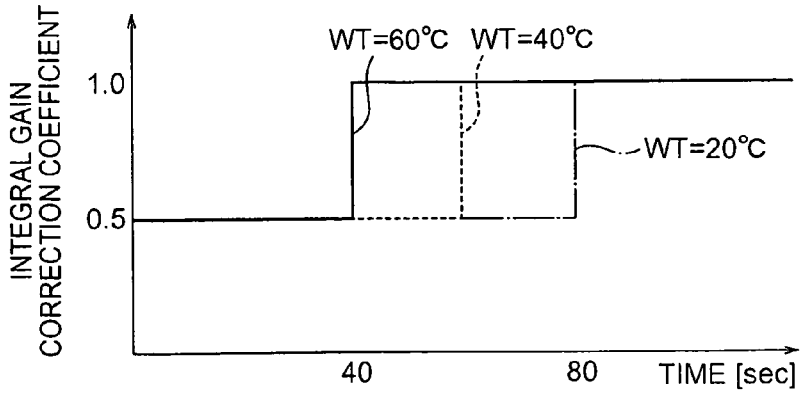
FIG. 16 is a diagram showing characteristics of a post-start elapsed time correction coefficient, by which an integral gain (Kit) is multiplied, with respect to an elapsed time after the start of the internal combustion engine.

FIG. 16 is a characteristic diagram showing characteristics of a post-start elapsed time correction coefficient, by which the integral gain (Kit) is multiplied, with respect to an elapsed time after the start of the engine.

The ECU 118, which is the control apparatus for controlling operation of the internal combustion engine according to the fourth embodiment of the present invention, performs operation control of the internal combustion engine 101 using coolant temperature detected by the coolant temperature detecting means as well as an air-fuel ratio and a post-start elapsed time. The characteristic retaining means further has a coolant temperature coefficient characteristic in which a coolant temperature coefficient for correcting an integral gain is determined by a coolant temperature. The ECU 118 functioning as the fuel correction amount calculating means further multiplies an integral gain by a coolant temperature coefficient in obtaining a correction amount of a fuel injection amount.

More specifically, the integral gain correction coefficient is set to be small (0.5) in a region where a sufficient length of time has not elapsed after the start of the engine, and is set to be large (1.0, that is, with no correction) after a predetermined time has elapsed since the start of the engine.

As indicated by broken lines (at a coolant temperature of 40° C.) and alternate dot and dash lines (at a coolant temperature of 20° C.) in FIG. 16, the post-start elapsed time for changing over the integral gain correction coefficient from the small value to the large value is changed according to the coolant temperature. When the timing for this changeover is retarded as the coolant temperature lowers, an integral gain corresponding to the coolant temperature is set. As a result, a much finer control processing can be realized.

Figure 17:
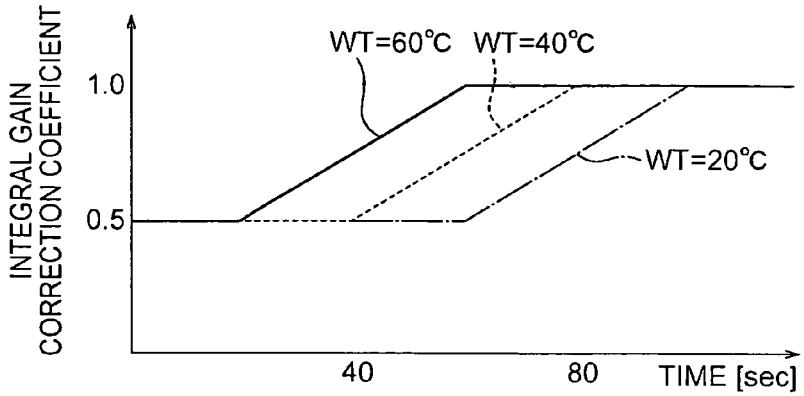
FIG. 17 is a diagram showing characteristics of the post-start elapsed time correction coefficient, by which the integral gain (Kit) is multiplied, with respect to an elapsed time after the start of the internal combustion engine.

FIG. 17 is a characteristic diagram showing characteristics of a post-start elapsed time correction coefficient, by which the integral gain (Kit) is multiplied, with respect to an elapsed time after the start of the engine.

The characteristics of FIG. 17 are different from those of FIG. 16 in that the characteristics show a transient region where the post-start elapsed time correction coefficient is gradually increased from a small value to a large value.

By using the characteristics, which show the transient region, of the post-start elapsed time correction coefficient with respect to the elapsed time, a finer control processing can be performed.

As described above, the integral gain of the $O_2$ feedback correction coefficient is corrected according to the elapsed time after the start of the engine. That is, the integral gain is corrected to a small value when a sufficient length of time has not elapsed after the start of the engine. Further, the time period during which the integral gain is corrected to the small value is prolonged as the coolant temperature lowers. Therefore, the air-fuel ratio A/F can be made lean, and as a result, the behavior of engine rotation can be stabilized.

Fifth Embodiment

Figure 18:
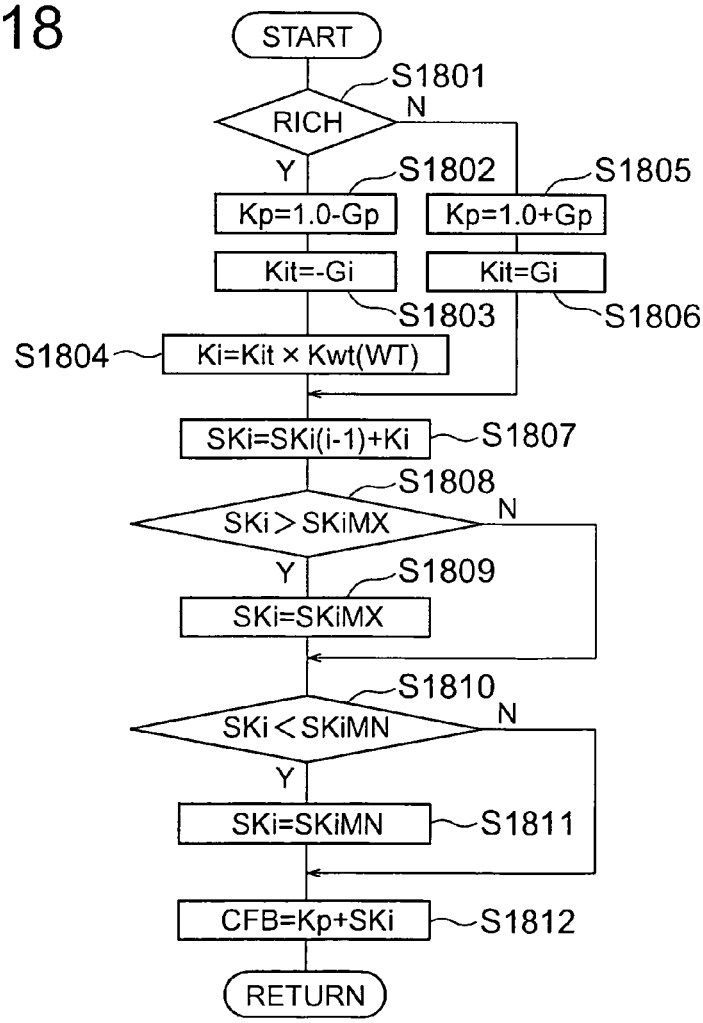
FIG. 18 is a flowchart showing the contents of a process for calculating an $O_2$ feedback correction amount (CFB) in a control apparatus for an internal combustion engine according to a fifth embodiment of the present invention.

FIG. 18 is a flowchart showing the contents of a process for calculating an $O_2$ feedback correction amount (CFB) in a control apparatus for an internal combustion engine according to the fifth embodiment of the present invention.

The ECU 118, which is the control apparatus for controlling operation of the internal combustion engine according to the fifth embodiment of the present invention, functions as fuel correction amount calculating means for setting again for obtaining a correction amount of a fuel injection amount based on coolant temperature or a post-start elapsed time only when air-fuel state determining means determines that the air-fuel ratio is rich.

As shown in FIG. 18, in Step S1801, it is determined based on an output signal from the $O_2$ sensor 108 whether or not the air-fuel ratio A/F is rich (RICH).

The output from the $O_2$ sensor 108 is approximately 1 V when the air-fuel ratio of exhaust gas is rich with respect to the stoichiometric air-fuel ratio, and is approximately 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S1801, based on the output signal of the $O_2$ sensor 108, that the air-fuel ratio A/F is rich, the flow proceeds to Step S1802.

In Step S1802, a proportional value (Kp) is obtained using the following equation.

$$Kp=1.0-Gp$$

Here, Gp represents a proportional gain.

In a subsequent step S1803, an integral gain (Kit) is set using the following equation.

$$\mathrm{Kit}=-Gi$$

In subsequent Step S1804, the integral gain (Kit) is multiplied by a coolant temperature coefficient (Kwt(WT)) to obtain the last integral gain (Ki).

On the other hand, when it is determined in Step S1801 that the air-fuel ratio A/F is lean because the output from the $O_2$ sensor 108 is equal to or smaller than the threshold (0.45 V), the flow proceeds to Step S1805.

In Step S1805, a proportional value (Kp) is obtained using the following equation.

$$Kp=1.0+Gp$$

Here, Gp represents a proportional gain.

In a subsequent step S1806, the integral gain (Kit) is set to Gi.

Furthermore, in a subsequent step S1807, the second last integral value (SKi (i−1)) and the final integral gain (Ki) are summed to obtain an integral value (SKi).

In Step S1808, it is determined whether or not the integral value (SKi) is larger than an integral upper limit (SKiMX).

When it is determined in Step S1808 that the integral value (SKi) is larger than the integral upper limit (SKiMX), the flow proceeds to Step S1809.

In Step S1809, the integral value (SKi) is set to the integral upper limit (SKiMX).

In a subsequent step S1810, it is determined whether or not the integral value (SKi) is smaller than an integral lower limit (SKiMN).

When it is determined in Step S1810 that the integral value (SKi) is smaller than the integral lower limit (SKiMN), the flow proceeds to Step S1811.

In Step S1811, the integral value (SKi) is set to the integral lower limit (SKiMN).

In a subsequent step S1812, the $O_2$ feedback correction amount (CFB) is set to the sum of the proportional value (Kp) and the integral value (SKi).

A coefficient obtained from the characteristic shown in FIG. 7 is used as the coolant temperature coefficient (Kwt (WT)).

As described above, with the control apparatus for the internal combustion engine according to the fifth embodiment of the present invention, the integral correction amount of the $O_2$ feedback correction coefficient is corrected according to the coolant temperature only on a decremental side, and the integral gain at the time when the coolant temperature is low is reduced only on the decremental side, thereby keeping the air-fuel ratio A/F from being corrected toward the lean side. As a result, the air-fuel ratio A/F can be made lean, and the behavior of engine rotation can thereby be stabilized.

The response speed of an incremental operation is increased because the correction gain toward the incremental side is not reduced. Furthermore, an effect of keeping the air-fuel ratio A/F from becoming lean is achieved.

Sixth Embodiment

Figure 19:
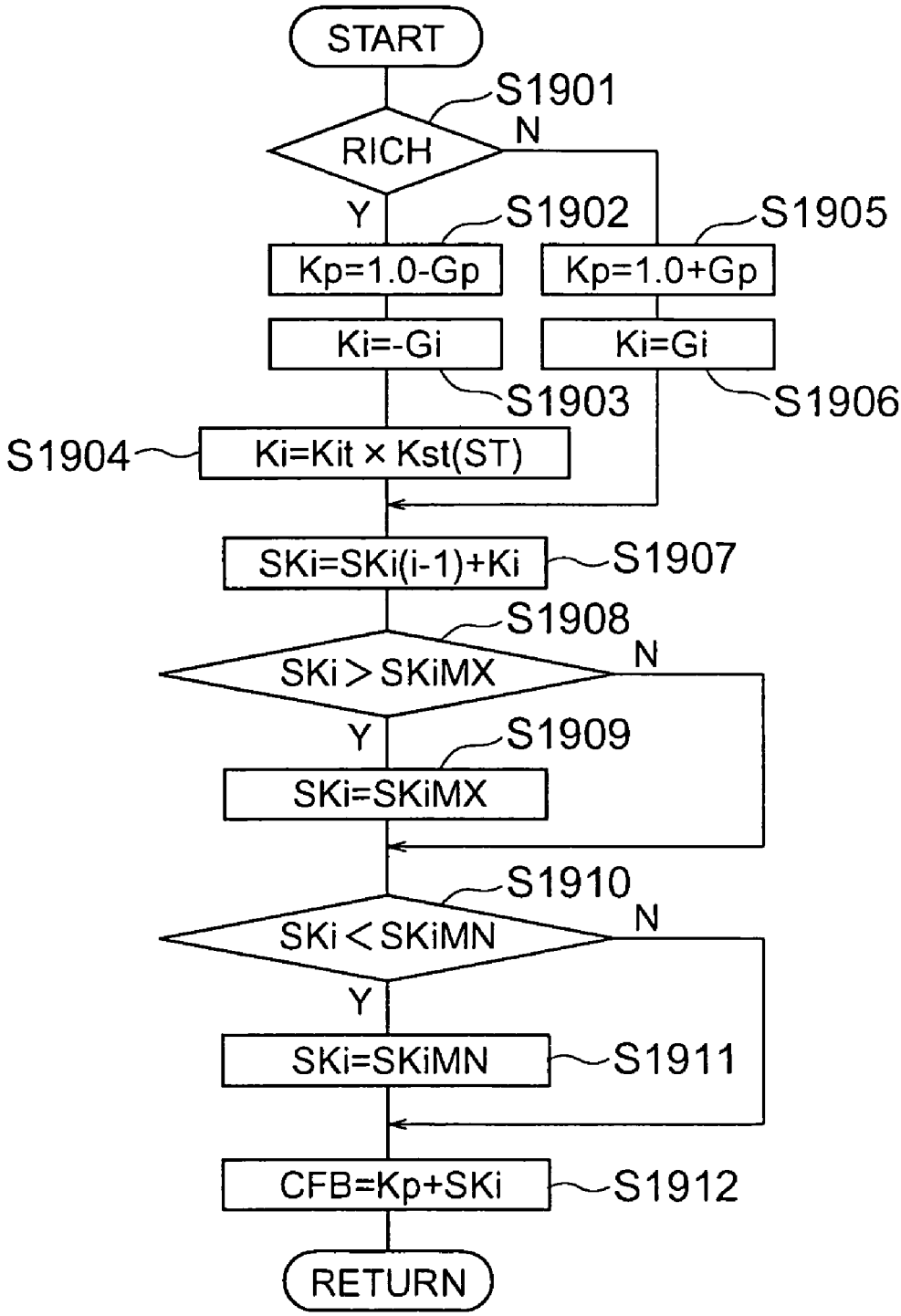
FIG. 19 is a flowchart showing the contents of a process for calculating an $O_2$ feedback correction amount (CFB) in a control apparatus for an internal combustion engine according to a sixth embodiment of the present invention.

FIG. 19 is a flowchart showing the contents of a process for calculating an $O_2$ feedback correction amount (CFB) in a control apparatus for an internal combustion engine according to the sixth embodiment of the present invention.

The ECU 118, which is the control apparatus for controlling operation of the internal combustion engine according to the sixth embodiment of the present invention, functions as fuel correction amount calculating means for setting again for obtaining a correction amount of a fuel injection amount based on a coolant temperature or a post-start elapsed time only when air-fuel state determining means determines that the air-fuel ratio is rich.

As shown in FIG. 19, in Step S1901, it is determined based on an output signal from the $O_2$ sensor 108 whether or not the air-fuel ratio A/F is rich (RICH).

The output from the $O_2$ sensor 108 is approximately 1 V when the air-fuel ratio of exhaust gas is rich with respect to the stoichiometric air-fuel ratio, and is approximately 0 V when the air-fuel ratio of exhaust gas is lean with respect to the stoichiometric air-fuel ratio. Thus, a threshold for determining whether the air-fuel ratio of exhaust gas is rich or lean with respect to the stoichiometric air-fuel ratio is set to 0.45 V, and a determination on the state of the air-fuel ratio is made using this threshold.

When it is determined in Step S1901, based on the output signal of the $O_2$ sensor 108, that the air-fuel ratio A/F is rich, the flow proceeds to Step S1902.

In Step S1902, a proportional value (Kp) is obtained using the following equation.

$$Kp=1.0-Gp$$

Here, Gp represents a proportional gain.

In a subsequent step S1903, an integral gain (Kit) is set using the following equation.

$$\mathrm{Kit}=-Gi$$

In Step S1904, the integral gain (Kit) is multiplied by a post-start correction coefficient (Kst(ST)) to obtain the last integral gain (Ki).

On the other hand, when it is determined in Step S1901 that the air-fuel ratio is not rich, the proportional value (Kp) is obtained by adding the proportional gain (Gp) to 1.0 in Step S1905. In Step S1906, the final integral gain (Ki) is set to Gi.

In a subsequent step S1907, the second last integral value (SKi(i−1)) and the final integral gain (Ki) are summed to obtain an integral value (SKi).

In Step S1908, it is determined whether or not the integral value (SKi) is larger than an integral upper limit (SKIMX). When it is determined in Step S1908 that the integral value (SKi) is larger than the integral upper limit (SKiMX), the integral value (SKi) is set to the integral upper limit (SKIMX) in Step S1909.

In Step S1910, it is determined whether or not the integral value (SKi) is smaller than an integral lower limit (SKIMN). When it is determined in Step S1910 that the integral value (SKi) is smaller than the integral lower limit (SKIMN), the integral value (SKi) is set to the integral lower limit (SKIMN) in Step S1911.

In Step S1912, the $O_2$ feedback correction amount (CFB) is set to the sum of the proportional value (Kp) and the integral value (SKi).

The post-start correction coefficient (Kst(ST)) is a coefficient shown in FIG. 10 or FIG. 11.

As described above, the integral correction amount of the $O_2$ feedback correction coefficient is corrected according to the post-start elapsed time only on a decremental side, and the integral gain at the time when a sufficient length of time has not elapsed after the start of the engine is reduced only on the decremental side, thereby keeping the air-fuel ratio A/F from being corrected toward the lean side. As a result, it is possible to restrain the air-fuel ratio A/F from becoming lean and the RPM from decreasing. The correction gain toward the incremental side of the air-fuel ratio A/F is not reduced, so the incremental operation is performed swiftly. Thus, it is possible to swiftly restrain the air-fuel ratio A/F from becoming lean.

Seventh Embodiment

Figure 20:
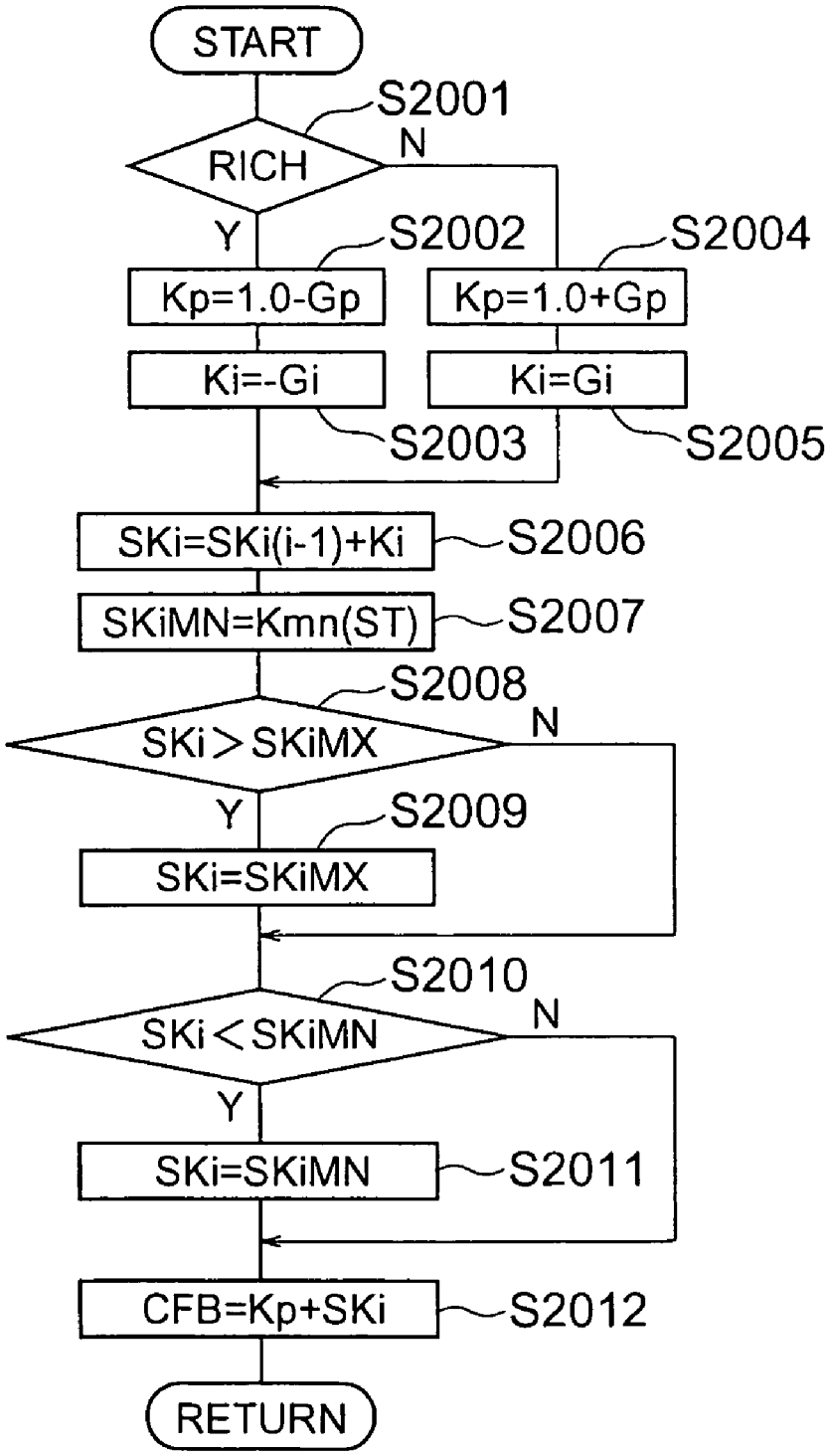
FIG. 20 is a view showing the concrete contents of another process for calculating an $O_2$ feedback correction amount (CFB) in Step S302 of FIG. 3.

FIG. 20 is a flowchart showing the concrete contents of another process for obtaining the $O_2$ feedback correction amount (CFB) in Step 302 of FIG. 3.

The ECU 118, which is a control apparatus for controlling operation of an internal combustion engine according to the seventh embodiment of the present invention, functions as fuel correction amount calculating means for setting only a minimum value and not a maximum value in integral calculation in calculating a gain for obtaining a correction amount of a fuel injection amount.

As shown in FIG. 20, in Step S2001, it is determined based on an output signal from the $O_2$ sensor 108 whether or not the air-fuel ratio A/F is rich (RICH). The $O_2$ sensor 108 has a characteristic of generating an output of approximately 1 V when the air-fuel ratio A/F is rich with respect to the stoichiometric air-fuel ratio and generating an output of approximately 0 V when the air-fuel ratio A/F is lean with respect to the stoichiometric air-fuel ratio. Therefore, the determination is made depending on whether the output signal from the $O_2$ sensor 108 is higher or lower than a threshold (0.45 V).

When it is determined in Step S2001 that the air-fuel ratio A/F is rich, a proportional value (Kp) is obtained by subtracting a proportional gain (Gp) from 1.0 in Step S2002, and an integral gain (Ki) is set to −Gi in Step S2003.

When it is determined in Step S2001 that the air-fuel ratio A/F is not rich, a proportional value (Kp) is calculated by adding a proportional gain (Gp) to 1.0 in Step S2004, and an integral gain (Ki) is set to Gi in Step S2005.

In Step S2006, the second last integral value (SKi(i−1)) and the integral gain (Ki) are summed to obtain an integral value (SKi).

In Step S2007, an integral lower limit (SKiMN) is obtained from a post-start elapsed time.

In Step S2008, it is determined whether or not the integral value (SKi) is larger than an integral upper limit (SKIMX). When it is determined in Step S2008 that the integral value (SKi) is larger than the integral upper limit (SKiMX), the integral value (SKi) is set to the integral upper limit (SKIMX) in Step S2009.

In Step S2010, it is determined whether or not the integral value (SKi) is smaller than an integral lower limit (SKIMN). When it is determined in Step S2010 that the integral value (SKi) is smaller than the integral lower limit (SKIMN), the integral value (SKi) is set to the integral lower limit (SKIMN) in Step S2011.

In Step S2012, the $O_2$ feedback correction amount (CFB) is set to the sum of the proportional value (Kp) and the integral value (SKi).

The integral lower limit (SKIMN) obtained from the post-start elapsed time is a value indicated as SKIMN shown in FIG. 13 or FIG. 14.

As described above, the lower limit of the $O_2$ feedback correction coefficient is set according to the post-start elapsed time, and the decrease in correction amount is suppressed as the post-start elapsed time is short. As a result, it is possible to restrain the air-fuel ratio A/F from becoming lean and the RPM from decreasing.

Eighth Embodiment

Figure 21:
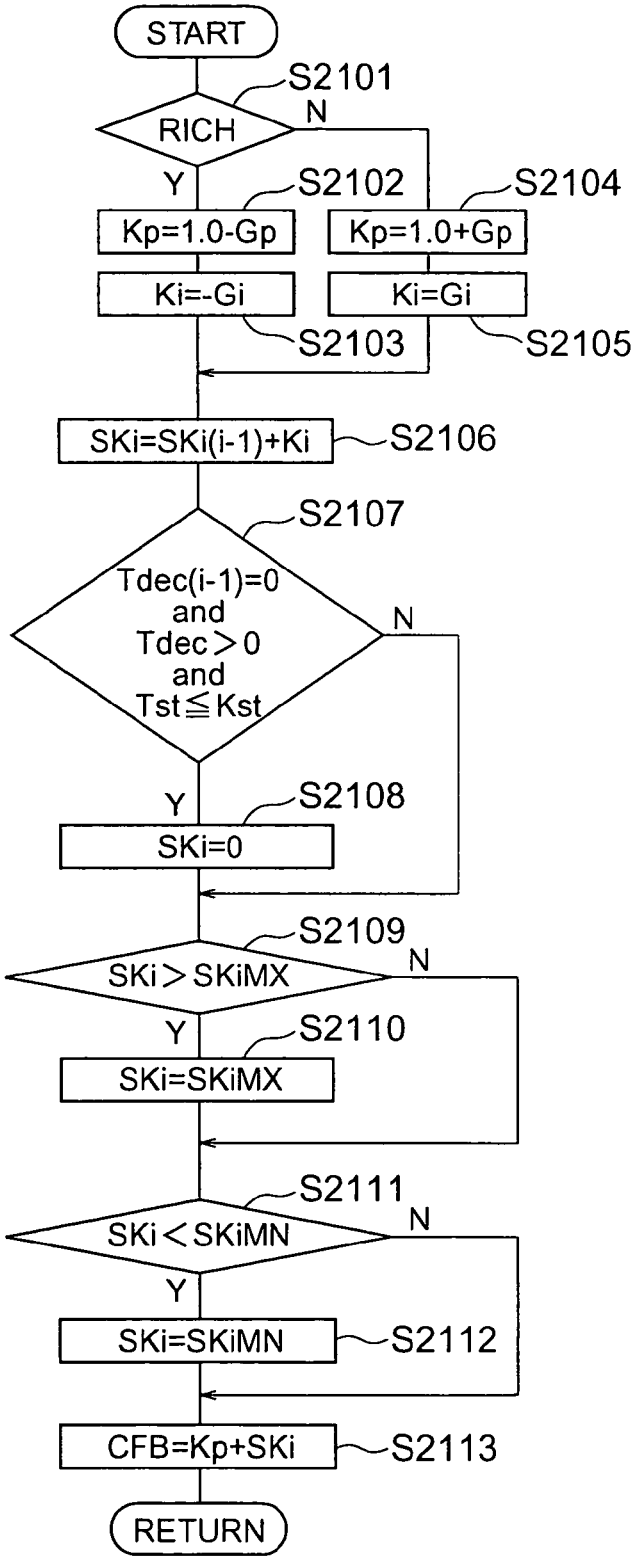
FIG. 21 is a view showing the concrete contents of still another process for calculating an $O_2$ feedback correction amount (CFB) in Step S302 of FIG. 3.

FIG. 21 is a flowchart showing the concrete contents of still another process for calculating an $O_2$ feedback correction amount (CFB) in Step S302 of FIG. 3.

The ECU 118, which is a control apparatus for controlling operation of an internal combustion engine according to the eighth embodiment of the present invention, is further equipped with RPM decrease detecting means for detecting a decrease in RPM of the internal combustion engine 101. The ECU 118 functions as fuel correction amount calculating means for initializing a correction amount of a fuel injection amount when the RPM decrease detecting means has detected a decrease in RPM of the internal combustion engine 101 within a predetermined period from the start of the engine.

The RPM decrease detecting means can be realized by monitoring a detection signal of the crank angle sensor 114 by means of the ECU 118.

As shown in FIG. 21, in Step S2101, it is determined based on an output signal from the $O_2$ sensor 108 whether or not the air-fuel ratio A/F is rich (RICH). The $O_2$ sensor 108 has a characteristic of generating an output of approximately 1 V when the air-fuel ratio A/F is rich with respect to the stoichiometric air-fuel ratio and generating an output of approximately 0 V when the air-fuel ratio A/F is lean with respect to the stoichiometric air-fuel ratio. Therefore, the determination is made depending on whether the output signal from the $O_2$ sensor 108 is higher or lower than the threshold (0.45 V).

When it is determined in Step S2101 that the air-fuel ratio A/F is rich, a proportional value (Kp) is obtained by subtracting a proportional gain (Gp) from 1.0 in Step S2102, and an integral gain (Ki) is set to −Gi in Step S2103.

When it is determined in Step S2101 that the air-fuel ratio A/F is not rich, a proportional gain (Kp) is obtained by adding a proportional gain (Gp) to 1.0 in Step S2104, and an integral gain (Ki) is set to Gi in Step S2105.

In Step S2106, the second last integral value (SKi(i−1)) and the integral gain (Ki) are summed to obtain an integral value (SKi).

In Step S2107, it is determined whether or not a post-start elapsed time (Tst) is equal to or shorter than a predetermined time (Kst) while the preceding deceleration decrease amount (Tdec(i−1)) is zero and a current deceleration decrease amount (Tdec) is not zero.

The deceleration decrease amount is set when the amount of a decreasing change in intake pipe pressure is equal to or larger than a predetermined value. A determination as to whether or not the deceleration decreasing amount has changed from zero to a value larger than zero means a determination as to whether or not deceleration has started.

Although the predetermined time (Kst) is a constant, it may be changed according to the coolant temperature at the time when the internal combustion engine 101 is started.

When the condition in Step S2107 is fulfilled (Yes), the integral value (SKi) is set to zero in Step S2108.

In Step S2109, it is determined whether or not the integral value (SKi) is larger than an integral upper limit (SKIMX). When it is determined in Step S2109 that the integral value (SKi) is larger than the integral upper limit (SKiMX), the integral value (SKi) is set to the integral upper limit (SKIMX) in Step S2110.

In Step S2111, it is determined whether or not the integral value (SKi) is smaller than an integral lower limit (SKIMN). When it is determined in Step S2111 that the integral value (SKi) is smaller than the integral lower limit (SKIMN), the integral value (SKi) is set to the integral lower limit (SKIMN) in Step S2112.

In Step S2113, the $O_2$ feedback correction amount (CFB) is set to the sum of the proportional value (Kp) and the integral value (SKi).

As described above, the integral value of the $O_2$ feedback correction amount is reset to zero when the RPM starts decreasing, namely, when a transition to a low-load region corresponding to unstable combustion is made. The integral value of the $O_2$ feedback integral value is thereby corrected toward the decremental side, so the air-fuel ratio A/F can be immediately returned to the rich side even when it is lean. Consequently, it is possible not only to suppress the occurrence of misfire resulting from exceeding a combustion limit and a decrease in RPM but also to avoid engine stall.

Ninth Embodiment

Figure 22:
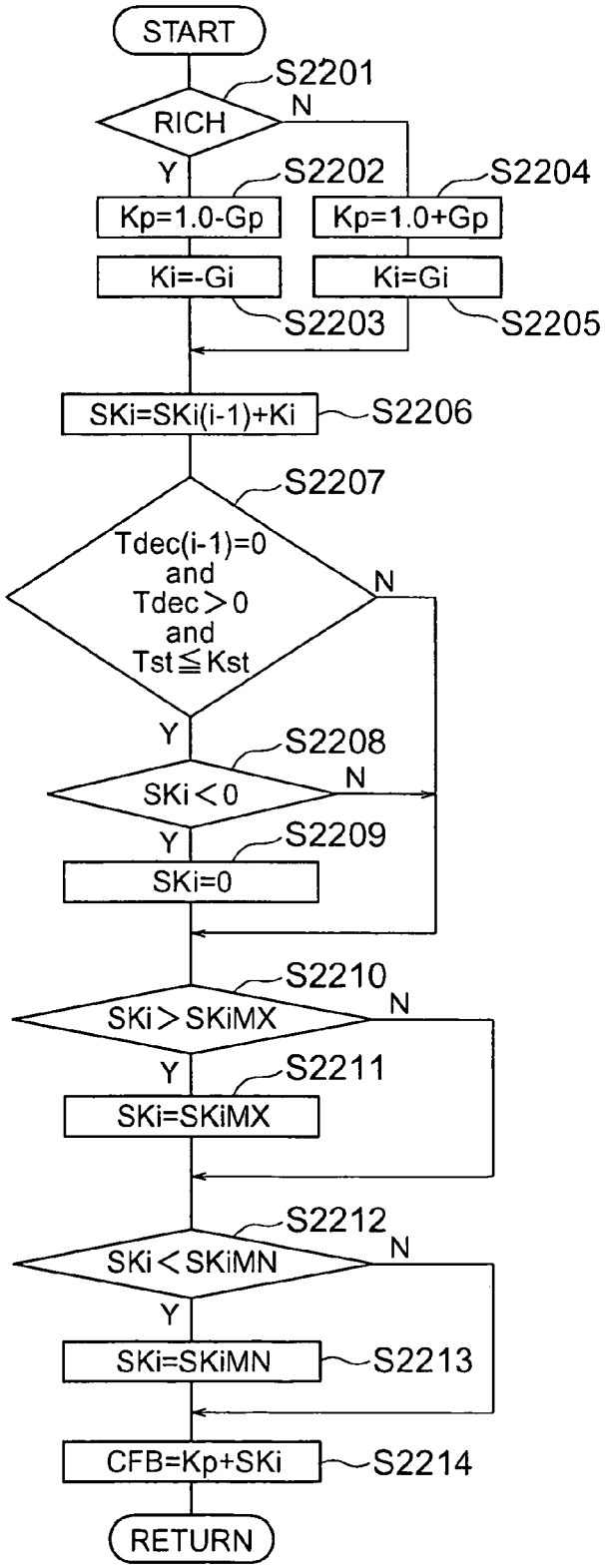
FIG. 22 is a view showing the concrete contents of still another process for calculating an $O_2$ feedback correction amount (CFB) in Step S302 of FIG. 3.

FIG. 22 is a flowchart showing the concrete contents of still another process for obtaining the $O_2$ feedback correction amount (CFB) in Step S302 of FIG. 3.

The ECU 118, which is a control apparatus for controlling operation of an internal combustion engine according to the ninth embodiment of the present invention, functions as fuel correction amount calculating means for initializing a correction amount of a fuel injection amount only when the air-fuel ratio state determining means determines that the air-fuel ratio is rich.

In Step S2201, it is determined based on an output signal from the $O_2$ sensor 108 whether or not the air-fuel ratio A/F is rich (RICH). The $O_2$ sensor 108 has a characteristic of generating an output of approximately 1 V when the air-fuel ratio A/F is rich with respect to the stoichiometric air-fuel ratio and generating an output of approximately 0 V when the air-fuel ratio A/F is lean with respect to the stoichiometric air-fuel ratio. Therefore, the determination is made depending on whether the output signal from the $O_2$ sensor 108 is higher or lower than the threshold (0.45 V).

When it is determined in Step S2201 that the air-fuel ratio A/F is rich, a proportional value (Kp) is obtained by subtracting a proportional gain (Gp) from 1.0 in Step S2202, and an integral gain (Ki) is set to −Gi in Step S2203.

When it is determined in Step S2201 that the air-fuel ratio A/F is not rich, a proportional value (Kp) is obtained by adding a proportional gain (Gp) to 1.0 in Step S2204, and an integral gain (Ki) is set to Gi in Step S2205.

In Step S2206, the second last integral value (SKi (i−1)) and the integral gain (Ki) are summed to obtain an integral value (SKi).

In Step S2207, it is determined whether or not a post-start elapsed time (Tst) is equal to or shorter than a predetermined time (Kst) while a last decrease amount of RPM (Tdec(i−1)) is zero and a current decrease amount of RPM (Tdec) is not zero.

The ECU 118 is so set as to make a determination on the decrease amount of RPM when the change amount on the negative side of intake pipe pressure is equal to or larger than a predetermined value. A determination as to whether or not the decrease amount of RPM has increased from zero to a value larger than zero means a determination as to whether or not the RPM has started decreasing.

Although the predetermined time (Kst) is a constant, it may be changed according to the coolant temperature at the time when the internal combustion engine 101 is started.

When the condition in Step S2207 is fulfilled (Yes), it is determined in Step S2208 whether or not the integral value (SKi) is smaller than zero.

When it is determined in Step S2208 that the integral value (SKi) is smaller than zero, the integral value (SKi) is set to zero in Step S2209.

In Step S2210, it is determined whether or not the integral value (SKi) is larger than an integral upper limit (SKiMX).

When it is determined in Step S2210 that the integral value (SKi) is larger than the integral upper limit (SKIMX), the integral value (SKi) is set to the integral upper limit (SKIMX) in Step S2211.

In Step S2212, it is determined whether or not the integral value (SKi) is smaller than an integral lower limit (SKiMN).

When it is determined in Step S2212 that the integral value (SKi) is smaller than the integral lower limit (SKIMN), the integral value (SKi) is set to the integral lower limit (SKIMN) in Step S2213.

In Step S2214, the $O_2$ feedback correction amount (CFB) is set to the sum of the proportional value (Kp) and the integral value (SKi).

As described above, the integral correction amount is reset to zero if the integral value of the $O_2$ feedback correction amount is smaller than zero (i.e., in a decremental correction state) especially when the RPM starts decreasing, namely, when a transition to a low-load region corresponding to unstable combustion is made. The integral value of $O_2$ feedback is thereby corrected toward the decremental side. Thus, the air-fuel ratio A/F can be immediately returned to the rich side even when it is lean. Consequently, it is possible not only to suppress the occurrence of misfire resulting from exceeding a combustion limit and a decrease in RPM but also to avoid engine stall.

What is claimed is:

1. A control apparatus for controlling operation of an internal combustion engine, comprising:

air-fuel ratio detecting means provided in an exhaust system of the internal combustion engine, for detecting an air-fuel ratio to be used to control operation of the internal combustion engine;

RPM detecting means for detecting RPM to be used to control operation of the internal combustion engine;

an intake pipe pressure sensor for detecting an intake pipe pressure to be used to control operation of the internal combustion engine;

coolant temperature detecting means for detecting a coolant temperature to be used to control operation of the internal combustion engine;

air-fuel ratio state determining means for determining whether the air-fuel ratio detected by the air-fuel ratio detecting means is in a rich state or in a lean state;

characteristic retaining means for retaining an integral gain characteristic in which a value of an integral gain is determined by RPM and an intake pipe pressure, a proportional gain characteristic in which a value of a proportional gain is determined by RPM and an intake pipe pressure, and a coolant temperature coefficient characteristic in which a coolant temperature coefficient for correcting the integral gain is determined according to a coolant temperature; and fuel correction amount calculating means for multiplying the integral gain by the coolant temperature coefficient in calculating a correction amount of a fuel injection amount using a sign obtained from a determination result of the air-fuel ratio state determining means, the integral gain, and the proportional gain, wherein the coolant temperature coefficient of the coolant temperature coefficient characteristic is set to be smaller than a constant value in a region where the coolant temperature is lower than a constant temperature.

2. A control apparatus for controlling operation of an internal combustion engine according to claim 1, wherein the coolant temperature coefficient characteristic is set such that the coolant temperature coefficient is changed over to a second level, which is larger than a first level, at a predetermined coolant temperature in a course of a rise in the coolant temperature, or that the coolant temperature coefficient is linearly or nonlinearly changed over to the second level, which is larger than the first level, in a predetermined coolant temperature range in a course of a rise in the coolant temperature.

3. A control apparatus for controlling operation of an internal combustion engine according to claim 1, wherein the characteristic retaining means retains an integral upper-limit characteristic in which an integral upper limit in integral calculation is increased to a second upper-limit level, which is higher than a first upper-limit level, in a course of a rise in the coolant temperature, and an integral lower-limit characteristic in which an integral lower limit in integral calculation is reduced to a second lower-limit level, which is lower than a first lower-limit level, in a course of a rise in the coolant temperature, and the fuel correction amount calculating means calculates the proportional gain and the integral gain for calculating the correction amount of the fuel injection amount using the integral upper-limit characteristic and the integral lower-limit characteristic.

4. A control apparatus for controlling operation of an internal combustion engine according to claim 3, wherein the fuel correction amount calculating means sets only a minimum value and not a maximum value in integral calculation in calculating the proportional gain and the integral gain for calculating the correction amount of the fuel injection amount.

5. A control apparatus for controlling operation of an internal combustion engine according to claim 1, wherein the fuel correction amount calculating means sets the proportional gain and the integral gain for calculating the correction amount of the fuel injection amount based on the coolant temperature, only when the air-fuel ratio state determining means has determined that the air-fuel ratio is in the rich state.

6. A control apparatus for controlling operation of an internal combustion engine according to claim 1, further comprising RPM decrease detecting means for detecting a decrease in RPM of the internal combustion engine, wherein the fuel correction amount calculating means initializes the correction amount of the fuel injection amount when the RPM decrease detecting means has detected a decrease in RPM of the internal combustion engine within a predetermined period after start of the internal combustion engine.

7. A control apparatus for controlling operation of an internal combustion engine according to claim 6, wherein the fuel correction amount calculating means initializes the correction amount of the fuel injection amount only when the air-fuel ratio state determining means has determined that the air-fuel ratio is in the rich state.

8. A control apparatus for controlling operation of an internal combustion engine, comprising:

air-fuel ratio detecting means provided in an exhaust system of the internal combustion engine, for detecting an air-fuel ratio to be used to control operation of the internal combustion engine;

RPM detecting means for detecting RPM to be used to control operation of the internal combustion engine;

an intake pipe pressure sensor for detecting an intake pipe pressure to be used to control operation of the internal combustion engine;

post-start elapsed time measuring means of the internal combustion engine for measuring a post-start elapsed time to be used to control operation of the internal combustion engine;

air-fuel ratio state determining means for determining whether the air-fuel ratio detected by the air-fuel ratio detecting means is in a rich state or in a lean state;

characteristic retaining means for retaining an integral gain characteristic in which a value of an integral gain is determined by RPM and an intake pipe pressure, a proportional gain characteristic in which a value of a proportional gain is determined by RPM and an intake pipe pressure, and an elapsed time coefficient characteristic in which an elapsed time coefficient for correcting the integral gain is determined according to a post-start elapsed time; and fuel correction amount calculating means for multiplying the integral gain by the elapsed time coefficient in calculating a correction amount of a fuel injection amount using a sign obtained from a determination result of the air-fuel ratio state determining means, the integral gain, and the proportional gain, wherein the elapsed time coefficient of the elapsed time coefficient characteristic is set to be smaller than a constant value in a region where the post-start elapsed time of the internal combustion engine is shorter than a predetermined time.

9. A control apparatus for controlling operation of an internal combustion engine according to claim 8, wherein the elapsed time coefficient characteristic is set such that the elapsed time coefficient is changed over to a second level, which is larger than a first level, as soon as a predetermined post-start elapsed time elapses, or that the elapsed time coefficient is linearly or nonlinearly changed over to the second level, which is larger than the first level, in a predetermined interval of the post-start elapsed time.

10. A control apparatus for controlling operation of an internal combustion engine according to claim 8, further comprising coolant temperature detecting means for detecting a coolant temperature to be used to control operation of the internal combustion engine in addition to the air-fuel ratio and the post-start elapsed time, wherein the characteristic retaining means further retains a coolant temperature coefficient characteristic in which a coolant temperature coefficient for correcting the integral gain is determined by a coolant temperature, and the fuel correction amount calculating means further multiplies the integral gain by the coolant temperature coefficient in calculating the correction amount of the fuel injection amount.

11. A control apparatus for controlling operation of an internal combustion engine according to claim 8, wherein the characteristic retaining means retains an integral upper-limit characteristic in which an integral upper limit in integral calculation is increased to a second upper-limit level, which is higher than a first upper-limit level, in a course of a lapse of the post-start elapsed time, and an integral lower-limit characteristic in which an integral lower limit in integral calculation is reduced to a second lower-limit level, which is lower than a first lower-limit level, in a course of a lapse of the post-start elapsed time, and the fuel correction amount calculating means calculates the proportional gain and the integral gain for calculating the correction amount of the fuel injection amount using the integral upper-limit characteristic and the integral lower-limit characteristic.

12. A control apparatus for controlling operation of an internal combustion engine according to claim 8, wherein the fuel correction amount calculating means sets the proportional gain and the integral gain for calculating the correction amount of the fuel injection amount based on the post-start elapsed time, only when the air-fuel ratio state determining means has determined that the air-fuel ratio is in the rich state.

13. A control apparatus for controlling operation of an internal combustion engine according to claim 8, further comprising RPM decrease detecting means for detecting a decrease in RPM of the internal combustion engine, wherein the fuel correction amount calculating means initializes the correction amount of the fuel injection amount when the RPM decrease detecting means has detected a decrease in RPM of the internal combustion engine within a predetermined period after start of the internal combustion engine.

* * * * *